US010761442B2

(12) United States Patent
Nakata et al.

(10) Patent No.: US 10,761,442 B2
(45) Date of Patent: Sep. 1, 2020

(54) ELECTROPHOTOGRAPHIC PHOTOSENSITIVE MEMBER, ELECTROPHOTOGRAPHIC APPARATUS, PROCESS CARTRIDGE, AND METHOD OF PRODUCING ELECTROPHOTOGRAPHIC PHOTOSENSITIVE MEMBER

(71) Applicant: CANON KABUSHIKI KAISHA, Tokyo (JP)

(72) Inventors: Koichi Nakata, Tokyo (JP); Haruki Mori, Ichikawa (JP); Shubun Kujirai, Toride (JP); Shinji Takagi, Yokohama (JP); Isao Kawata, Kawasaki (JP); Yuto Ito, Koganei (JP); Ryuji Higashi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/430,860

(22) Filed: Jun. 4, 2019

(65) Prior Publication Data

US 2019/0391504 A1 Dec. 26, 2019

(30) Foreign Application Priority Data

Jun. 22, 2018 (JP) ..... 2018-118897

(51) Int. Cl.
*G03G 5/07* (2006.01)
*G03G 5/147* (2006.01)

(52) U.S. Cl.
CPC ..... *G03G 5/071* (2013.01); *G03G 5/14717* (2013.01); *G03G 5/14734* (2013.01); *G03G 5/14786* (2013.01)

(58) Field of Classification Search
CPC ..... G03G 5/071; G03G 5/14717; G03G 5/14734; G03G 5/14786
USPC ..... 430/58.7, 66
See application file for complete search history.

(56) References Cited

U.S. PATENT DOCUMENTS 5,585,214 A * 12/1996 Kashimura ..... G03G 5/0564 430/56
6,004,710 A * 12/1999 Takagi ..... G03G 5/14791 430/66
6,773,856 B2 8/2004 Tanaka et al.
7,186,489 B2 3/2007 Uematsu et al.
7,226,711 B2 6/2007 Amamiya et al.
7,245,851 B2 7/2007 Fujii et al.
7,534,534 B2 5/2009 Nakata et al.
7,732,113 B2 6/2010 Nakamura et al.
8,343,699 B2 1/2013 Nagasaka et al.
8,465,889 B2 6/2013 Sekido et al.
8,524,430 B2 9/2013 Takagi et al.
8,546,050 B2 10/2013 Maruyama et al.
8,632,931 B2 1/2014 Sekido et al.
8,673,526 B2 * 3/2014 Sonobe ..... G03G 5/0542 430/56
8,795,936 B2 8/2014 Sekido et al.
9,316,931 B2 4/2016 Takagi et al.
9,389,523 B2 7/2016 Nakata et al.
9,594,318 B2 3/2017 Nakata et al.
9,740,117 B2 8/2017 Kosaka et al.
9,851,648 B2 12/2017 Nishi et al.
10,042,272 B2 8/2018 Mori et al.
10,120,331 B2 11/2018 Nakata et al.
10,310,395 B2 6/2019 Nakata et al.
10,481,512 B2 * 11/2019 Black ..... G03G 5/071
10,495,991 B2 * 12/2019 Black ..... G03G 5/0614
2010/0248101 A1 9/2010 Yamada et al.
2018/0329317 A1 11/2018 Mori et al.
2018/0335708 A1 11/2018 Nakata et al.
2019/0049867 A1 2/2019 Tokimitsu et al.
2019/0056676 A1 2/2019 Nakata et al.
2019/0094726 A1 3/2019 Mori et al.

FOREIGN PATENT DOCUMENTS

EP 2 527 923 11/2012
JP 05173350 A * 7/1993
JP 09325509 A * 12/1997
JP 2007-011005 1/2007
JP 2007-011006 1/2007
JP 2007-272191 10/2007
JP 2007-272192 10/2007
JP 2007-279678 10/2007
JP 2008-070761 3/2008
JP 2016-051030 4/2016
JP 2016-161699 9/2016

OTHER PUBLICATIONS

U.S. Appl. No. 16/416,929, Haruki Mori, filed May 20, 2019.
U.S. Appl. No. 16/423,337, Yuka Ishiduka, filed May 28, 2019.
U.S. Appl. No. 16/423,418, Hiroyuki Watanabe, filed May 28, 2019.
U.S. Appl. No. 16/423,429, Nobuhiro Nakamura, filed May 28, 2019.

* cited by examiner

*Primary Examiner* — Christopher D Rodee
(74) *Attorney, Agent, or Firm* — Venable LLP

(57) ABSTRACT

Provided are an electrophotographic photosensitive member including a support and a photosensitive layer above the support, in which a surface layer of the electrophotographic photosensitive member includes a polymerization product of a composition containing a specific hole transporting compound, and an electrophotographic apparatus and a process cartridge including the electrophotographic photosensitive member. Also provided is a method of producing the electrophotographic photosensitive member, including (i) forming a coating film of a coating solution for a surface layer which is a composition containing a specific hole transporting compound, and (ii) forming the surface layer of the electrophotographic photosensitive member by a polymerization reaction of the composition containing the specific hole transporting compound.

11 Claims, 4 Drawing Sheets

ELECTROPHOTOGRAPHIC PHOTOSENSITIVE MEMBER, ELECTROPHOTOGRAPHIC APPARATUS, PROCESS CARTRIDGE, AND METHOD OF PRODUCING ELECTROPHOTOGRAPHIC PHOTOSENSITIVE MEMBER

BACKGROUND OF THE INVENTION

Field of the Invention

The present invention relates to an electrophotographic photosensitive member, an electrophotographic apparatus having the electrophotographic photosensitive member, a process cartridge having the electrophotographic photosensitive member, and a method of producing the electrophotographic photosensitive member.

Description of the Related Art

Since stress is repeatedly applied to a surface layer of an electrophotographic photosensitive member (hereinafter, also referred to as a photosensitive member) by a series of electrophotographic processes such as charging, exposure, development, transfer, and cleaning, wear resistance and chemical stability are required.

As a method for improving wear resistance, a method of incorporating a curable resin in the surface layer of the electrophotographic photosensitive member can be used. However, when a surface layer having high wear resistance is provided, the surface layer is less likely to wear out, whereby removal along with wear of a chemically deteriorated surface of the surface layer does not proceed and chemical deterioration is likely to accumulate on the surface. Chemical deterioration refers to a phenomenon in which a hole transporting compound of the surface layer of the photosensitive member causes a chemical change by the stress due to the series of the above-mentioned electrophotographic processes. The chemical change of the hole transporting compound sometimes causes a phenomenon in which an electrophotographic image output after repeated use under a high temperature and high humidity environment becomes unclear (hereinafter, also referred to as smeared image). Therefore, in order to suppress smeared image, it is required to suppress the chemical change of the hole transporting compound.

As a method to improve chemical stability of the hole transporting compound, there is a technique to incorporate an additive together with the hole transporting compound in the surface layer. Japanese Patent Application Laid-Open No. 2007-11005 discloses a technique to improve smeared image by adding a specific fluorine atom-containing monomer having a polymerizable functional group to a surface layer. Japanese Patent Application Laid-Open Nos. 2007-11006 and 2016-51030 disclose a technique to include a specific fluorine atom-containing hole transporting monomer in the surface layer. Japanese Patent Application Laid-Open Nos. 2007-272191, 2007-272192, and 2007-279678 disclose a technique to improve smeared image by adding a specific amine compound to the surface layer. Japanese Patent Application Laid-Open No. 2008-70761 discloses a technique to improve smeared image by adding a specific siloxane compound having a specific polymerizable functional group to a surface layer.

A technique using the compounds of Japanese Patent Application Laid-Open Nos. 2007-11005, 2007-272191, 2007-272192, 2007-279678, and 2008-70761 is a technique for alleviating the above-described stress exposure to the hole transporting compound, but is not a technique for improving chemical stability as the hole transporting compound. In addition, Japanese Patent Application Laid-Open No. 2007-11006 discloses making the surface layer have low surface energy, but discloses neither chemical deterioration of the surface layer nor a potential fluctuation when used repeatedly under a low humidity environment. The technique of Japanese Patent Application Laid-Open No. 2016-51030 does not disclose suppression of a potential fluctuation during repeated use under a low humidity environment.

In order to improve smeared image, it is required not only to alleviate the above-described stress exposure, but also to improve chemical stability of the hole transporting compound itself. In addition, it is also required to improve the potential fluctuation when a highly durable photosensitive member is repeatedly used under a low humidity environment.

SUMMARY OF THE INVENTION

Therefore, an embodiment of the present invention is to provide an electrophotographic photosensitive member which has wear resistance, suppresses smeared image under a high temperature and high humidity environment, and also, has a small potential fluctuation when repeatedly used under a low temperature and low humidity environment.

Another embodiment of the present invention is to provide an electrophotographic apparatus having the electrophotographic photosensitive member.

Another embodiment of the present invention is to provide a process cartridge having the electrophotographic photosensitive member.

Still another embodiment of the present invention is to provide a method of producing the electrophotographic photosensitive member.

The electrophotographic photosensitive member according to an embodiment of the present invention is an electrophotographic photosensitive member including a support and a photosensitive layer above the support, in which a surface layer of the electrophotographic photosensitive member includes a polymerization product of a composition containing a hole transporting compound represented by the following Formula (1):

(1)

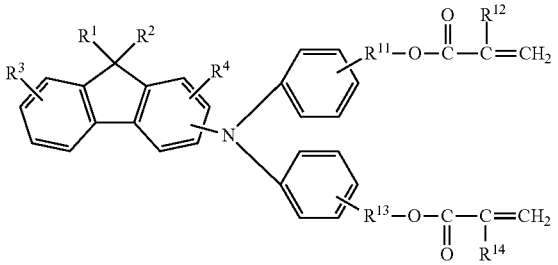

in Formula (1), $R^1$ and $R^2$ independently represent an alkyl group having 2 or more and 8 or less carbon atoms, $R^3$ and $R^4$ independently represent a hydrogen atom or an alkyl group having 4 or less carbon atoms, $R^{11}$ and $R^{13}$ independently represent an alkylene group having 3 or more and 6 or less carbon atoms, and $R^{12}$ and $R^{14}$ independently represent a hydrogen atom or a methyl group.

In addition, the electrophotographic apparatus according to another embodiment of the present invention includes the electrophotographic photosensitive member, a charging unit, an exposing unit, a developing unit, and a transfer unit.

In addition, the process cartridge according to another embodiment of the present invention supports the electrophotographic photosensitive member integrally with at least one unit selected from the group consisting of a charging unit, a developing unit, a transfer unit, and a cleaning unit, in which the process cartridge is detachably attachable to an electrophotographic apparatus main body.

Further, a method of producing an electrophotographic photosensitive member according to still another embodiment of the present invention is a method of producing an electrophotographic photosensitive member including a support and a photosensitive layer above the support, including:

(i) forming a coating film of a coating solution for a surface layer which is a composition containing a hole transporting compound represented by the following Formula (1); and (ii) forming the surface layer of the electrophotographic photosensitive member by a polymerization reaction of the composition containing the hole transporting compound represented by the following Formula (1) in the coating film:

(1)

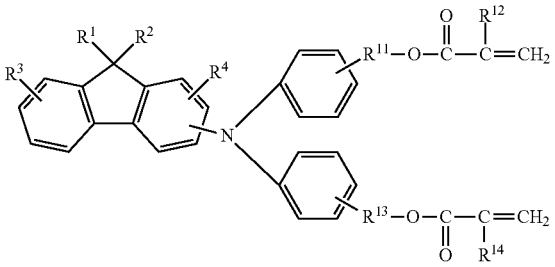

in Formula (1), $R^1$ and $R^2$ independently represent an alkyl group having 2 or more and 8 or less carbon atoms, $R^3$ and $R^4$ independently represent a hydrogen atom or an alkyl group having 4 or less carbon atoms, $R^{11}$ and $R^{13}$ independently represent an alkylene group having 3 or more and 6 or less carbon atoms, and $R^2$ and $R^{14}$ independently represent a hydrogen atom or a methyl group.

Further features of the present invention will become apparent from the following description of exemplary embodiments with reference to the attached drawings.

DESCRIPTION OF THE EMBODIMENTS

Figure 1:
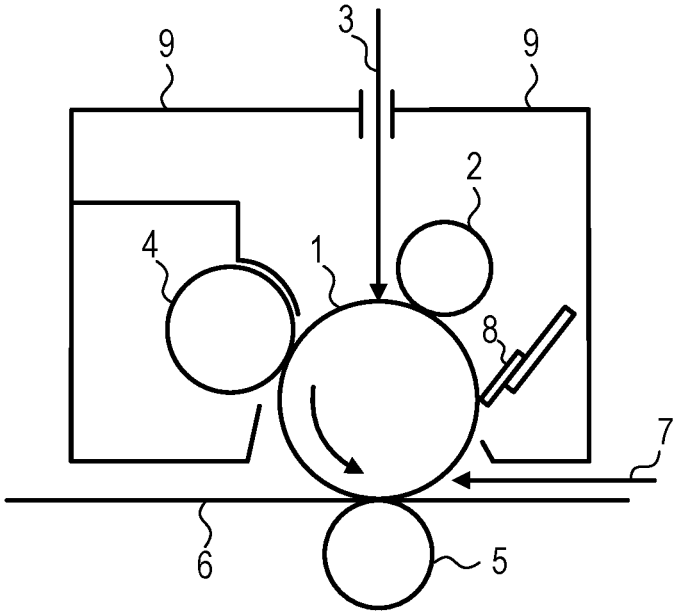
FIG. 1 is a schematic diagram illustrating an example of a process cartridge having an electrophotographic photosensitive member.

An electrophotographic photosensitive member of an embodiment of the present invention includes a polymerization product of a composition containing a hole transporting compound having a polymerizable functional group in a surface layer, and the hole transporting compound has a specific aminofluorene structure. Hereinafter, a hole transporting compound having a polymerizable functional group having these characteristics is also referred to as a hole transporting compound according to the present invention.

Generally, as a hole transporting compound used in an electrophotographic photosensitive member, an arylamine compound having excellent hole transport properties is widely used.

It is considered that the amine structure exhibits an electron donating property, forms a molecular orbital between an aryl group around a nitrogen atom and the like, and causes oxidation/reduction, thereby expressing the hole transport properties of the arylamine compound. On the other hand, it is considered that the arylamine moiety is in the state of being susceptible to a chemical reaction or the like since charge transfer is actively performed through the repeated electrophotographic process. In particular, it is considered that the arylamine moiety tends to be susceptible to change such as oxidation, by an action of energy of discharge in a charging step and ozone or an oxidizing material produced by a discharge phenomenon.

As a result, it is presumed that the chemical change of the arylamine moiety has been caused. In particular, it is considered that the chemical change of the hole transporting compound, generation of a discharge product, and moisture from the environment are combined in a high temperature and high humidity environment, thereby causing resistance of a photosensitive member surface to be decreased, and generating image failure such as a so-called smeared image.

The present inventors searched for a hole transporting compound which can suppress deterioration even through repeated electrophotographic processes and function with high stability and high durability, thereby completing the present invention.

The hole transporting compound according to the present invention has the following characteristics. The hole transporting compound according to the present invention is formed by a structure having an alkyl group having a specific number of carbon atoms at a specific position in a molecule. That is, the hole transporting compound has an alkyl group having a specific number of carbon atoms at a 9-position of fluorene, in the hole transporting compound having a fluorene structure. It is considered that by having the characteristics, the hydrophobicity of the hole transporting compound can be improved to effectively decrease affinity with moisture. As a result, a decrease in resistance can be suppressed.

However, when the hole transporting compound has an alkyl group having an excessive number of carbon atoms, specific electrical properties may be deteriorated. In particular, when continuously used in a low temperature and low humidity environment, a potential fluctuation of bright portion potential of a photosensitive member may be increased.

Along with the above problems, particularly in an electrophotographic apparatus which outputs a color image, a tint variation of the image occurs while continuous image output is performed from the beginning of printing.

The present inventors conducted an intensive study, and as a result, found that by using a polymerization product of a composition containing a hole transporting compound according to the present invention in a surface layer, the above problem can be effectively improved.

It is considered that the above problem can be improved, since the hole transporting compound according to the present invention has an alkyl group having a specific number of carbon atoms at a site which is unlikely to adversely affect a hole transport function, thereby achieving both chemical stability and electrical properties.

The hole transporting compound according to the present invention is a compound represented by the following Formula (1) and has a fluorene structure:

(1)

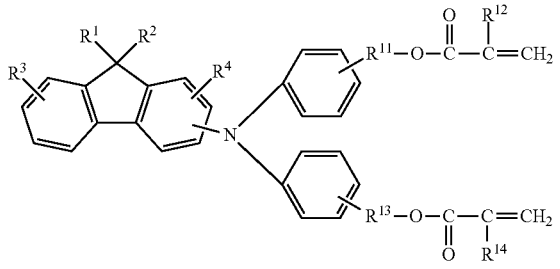

in Formula (1), $R^1$ and $R^2$ independently represent an alkyl group having 2 or more and 8 or less carbon atoms, $R^3$ and $R^4$ independently represent a hydrogen atom or an alkyl group having 4 or less carbon atoms, $R^{11}$ and $R^{13}$ independently represent an alkylene group having 3 or more and 6 or less carbon atoms, and $R^{12}$ and $R^{14}$ independently represent a hydrogen atom or a methyl group.

The requirements essential to the hole transporting compound according to the present invention are divided into each partial structure of Formula (1) and described below.

In the hole transporting compound according to the present invention, an alkyl group having 2 or more and 8 or less carbon atoms represented by $R^1$ and $R^2$ is bonded at the 9-position of a so-called fluorene structure.

The fluorene structure is formed so that a 5-membered ring and a 6-membered ring are condensed, and has high planarity. On the other hand, only the carbon atom positioned at the 9-position of the fluorene structure is the carbon atom forming an $sp^3$ hybrid orbital, and is positioned in a direction different from a plane formed by three fused rings. It is considered that due to the positional relationship, a structure in which hole transport properties are hardly inhibited even with a large number of carbon atoms is formed.

For the above reasons, it is presumed that it is possible not to inhibit hole transport properties, while an alkyl group having a large number of carbon atoms is present in the vicinity of an aromatic amino group of the hole transporting compound.

By the presence of the alkyl group having a large number of carbon atoms, hydrophobicity of the hole transporting compound can be improved and smeared image under a high temperature and high humidity environment can be improved.

In the hole transporting structure of the above Formula (1), when an alkyl group bonded at the 9-position of the fluorene structure has an excessively long carbon chain, there is a possibility of inhibiting the electrical properties, and thus, the alkyl group has 8 or less and more preferably 6 or less carbon atoms. More preferably, the alkyl group has 2 or more and 5 or less carbon atoms. Further, a propyl group is preferred.

It is considered that when the carbon chain of the alkyl group is excessively long, steric hindrance becomes large due to an aromatic amino group and the like and disorder on the surface layer becomes high, thereby inhibiting hole transport properties.

Examples of the alkyl group represented by $R^1$ and $R^2$ include a methyl group, an ethyl group, an n-propyl group, an isopropyl group, an n-butyl group, an isobutyl group, a sec-butyl group, a tert-butyl group, an n-pentyl group, an isopentyl group, a neopentyl group, a tert-pentyl group, a cyclopentyl group, an n-hexyl group, a 1-methylpentyl group, a 4-methyl-2-pentyl group, a 3,3-dimethylbutyl group, a 2-ethylbutyl group, a 1-methylhexyl group, a 4-tert-butylcyclohexyl group, an n-heptyl group, a 2-methylheptyl group, an n-octyl group, and the like.

The hole transporting compound according to the present compound may have an alkyl group having 4 or less carbon atoms represented by $R^3$ and $R^4$. By having the alkyl group having 4 or less carbon atoms represented by $R^3$ and $R^4$, solubility of the hole transporting compound according to the present invention and compatibility thereof with surrounding materials or the like are improved. Since the alkyl group represented by $R^3$ and $R^4$ is directly bonded to a benzene ring of fluorene, an excessively long carbon chain causes steric hindrance. Therefore, the alkyl group represented by $R^3$ and $R^4$ has 4 or less carbon atoms. Examples of the alkyl group represented by $R^3$ and $R^4$ include a methyl group, an ethyl group, an n-propyl group, an isopropyl group, an n-butyl group, an isobutyl group, a sec-butyl group, a tert-butyl group, and the like.

The hole transporting compound according to the present invention has an alkylene group represented by $R^{11}$ and $R^{13}$ between a benzene ring and a polymerizable functional group, as shown in Formula (1).

The partial structure is considered to affect an energy value of a molecular orbital of the hole transporting compound. In particular, the highest occupied molecular orbital (HOMO) in the molecular orbital is related to hole transport properties, and having an energy value in an appropriate range is important for hole transport properties.

In particular, in order to suppress fluctuations in a bright portion potential in a photosensitive member after repeated use under a low temperature and low humidity environment, it is important to design the molecule so that the HOMO energy value of the hole transporting compound according to the present invention can be maintained within an appropriate range.

That is, by optimizing the HOMO energy value of the hole transporting compound contained in the surface layer under the condition in which hole injection and transport properties are likely to be deteriorated, such as a low temperature and low humidity environment, injection and transport of charge from an adjacent layer can be made better.

It is presumed that the hole transporting compound according to the present invention has a fluorene structure in which a conjugated structure is widely spread in a plane, and further the HOMO energy value is within a specific range to produce a synergistic effect. It is preferred that the HOMO energy value which is calculated by a density functional method (B3LYP/6-31G*) of the compound represented by Formula (1) is −4.9 (eV) or more and −4.7 (eV) or less.

The alkylene group represented by $R^{11}$ and $R^{13}$ in Formula (1) has 3 or more and 6 or less carbon atoms. When the alkylene group represented by $R^{11}$ and $R^{13}$ has 3 or more carbon atoms, the HOMO energy value of the hole transporting compound is −4.9 (eV) or more, which does not fall below the appropriate range.

In addition, when the alkylene has 6 or less carbon atoms, the alkyl group in the vicinity of an aromatic amine structure has an appropriate length, thereby maintaining hole transport properties. When the alkylene group represented by $R^{11}$ and $R^{13}$ has more than 7 carbon atoms, a component of the alkylene chain causing steric hindrance is increased to be a factor of inhibiting hole transport properties. As a result, residual potential of the photosensitive member rises and the potential fluctuation under a low temperature and low humidity environment increases.

Examples of the alkylene group represented by $R^{11}$ and $R^{13}$ include an n-propylene group, an iso-propylene group, an n-butylene group, an iso-butylene group, a sec-butylene group, a tert-butylene group, an n-pentylene group, a 1-methyl-n-butylene group, a 2-methyl-n-butylene group, a 3-methyl-n-butylene group, a 1,1-dimethyl-n-propylene group, a 1,2-dimethyl-n-propylene group, a 2,2-dimethyl-n-propylene group, a n-hexylene group, a 1-methyl-n-pentylene group, a 2-methyl-n-pentylene group, a 1,1-dimethyl-n-butylene group, a 1,2-dimethyl-n-butylene group, and the like.

In Formula (1), a substitution position of the fluorene structure of the amino group is preferably a so-called 2-position or 4-position of fluorene, from a viewpoint of easiness of compound synthesis and electrical properties of the photosensitive member. In particular, a structure substituted at the 2-position is preferred.

In the electrophotographic photosensitive member according to an embodiment of the present invention, it is preferred that the surface layer includes a copolymerization product of the composition containing the hole transporting compound represented by Formula (1) and a compound represented by the following Formula (2):

(2)

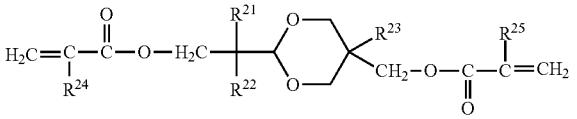

in Formula (2), $R^{21}$ and $R^{22}$ independently represent an alkyl group having 1 or more and 4 or less carbon atoms or a substituted or unsubstituted benzyl group, in which the substituent of the benzyl group is an alkyl group having 4 or less carbon atoms, and $R^{21}$ and $R^{22}$ may be bonded to each other to form a ring, $R^{23}$ represents an alkyl group having 1 or more and 4 or less carbon atoms, and $R^{24}$ and $R^{25}$ independently represent a hydrogen atom or a methyl group.

The compound represented by Formula (2) does not have hole transport properties. When the compound represented by Formula (2) is used simultaneously with the hole transporting compound represented by Formula (1), the effect of the present invention is further improved, thereby improving smeared image under a high temperature and high humidity environment and a potential fluctuation when used repeatedly under a low temperature and low humidity environment, in a well-balanced manner.

The compound represented by Formula (2) has an appropriate molecular weight and molecular size, and is presumed to have an effect of improving denseness of a film containing the compound represented by Formula (1), thereby suppressing infiltration of moisture from the environment into a membrane. In addition, since the compound represented by Formula (2) has an appropriate low molecular weight and serves to supplement physical strength of the polymerization product, the compound has an effect of compensating for film strength and improving wear resistance.

$R^{21}$ and $R^{22}$ independently represent an alkyl group having 1 or more and 4 or less carbon atoms or a substituted or unsubstituted benzyl group. Examples of the substituent of the benzyl group include an alkyl group having 4 or less carbon atoms. Examples of the alkyl group include a methyl group, an ethyl group, an n-propyl group, an isopropyl group, an n-butyl group, an isobutyl group, a sec-butyl group, a tert-butyl group, and the like.

In order to obtain the effect of the present application, it is preferred that $R^{21}$ and $R^{22}$ are an alkyl group having 1 to 4 carbon atoms. The molecular weight becomes compact and it is easy to improve denseness of the film. Further, it is preferred that at least one of $R^{21}$ and $R^{22}$ is an alkyl group having 2 or more carbon atoms. This makes it possible to optimally control hydrophobicity and film denseness of the compound represented by Formula (2), thereby improving electrical properties when used in the surface of the photosensitive member.

$R^{21}$ and $R^{22}$ may be bonded to each other to form a ring. When forming a ring, examples of the ring include a cyclopentane ring, a cyclohexane ring, a cycloheptane ring, and the like. $R^{23}$ is an alkyl group having 1 or more and 4 or less carbon atoms. It is preferred that $R^{23}$ is a methyl group or an ethyl group from a viewpoint of obtaining the effect of the present invention.

When a ratio of the compound represented by Formula (2) to the hole transporting compound represented by Formula (1) is excessive, charge transporting properties of the surface layer are lowered. Therefore, electrical properties are deteriorated and the potential fluctuation after repeated use is increased. Accordingly, it is preferred that the content of the hole transporting compound represented by Formula (1) in a coating solution for a surface layer is 50% by mass or more with respect to the total mass of the hole transporting compound represented by Formula (1) and the compound represented by Formula (2) in the coating solution for a surface layer.

As a method for causing a polymerization reaction of the composition, a method for imparting energy such as ultraviolet rays, an electron beam, and heat, or a method for causing co-exist of compounds, for example, an auxiliary agent such as a polymerization initiator, an acid, an alkali, and a complex can be used.

The polymerizable functional group of the hole transporting compound represented by Formula (1) and the compound represented by Formula (2) is an acryloyloxy group or a methacryloyloxy group, from a viewpoint of wear resistance of the surface layer and a polymerization reaction rate during polymerization.

Accordingly, $R^{12}$ and $R^{14}$, and $R^{24}$ and $R^{25}$ independently represent a hydrogen atom or a methyl group.

Examples of the hole transporting compound represented by Formula (1) are shown below. However, the compound is not limited to the following examples.

Exemplary Compound No. 1-1
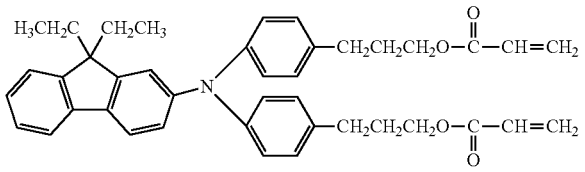
Exemplary Compound No. 1-2
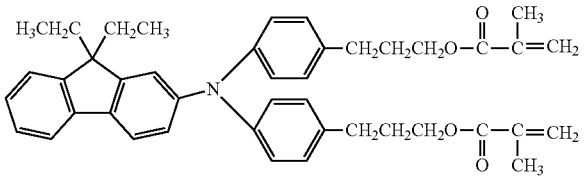
Exemplary Compound No. 1-3
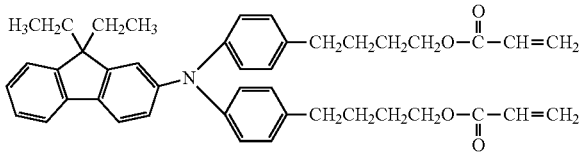
Exemplary Compound No. 1-4
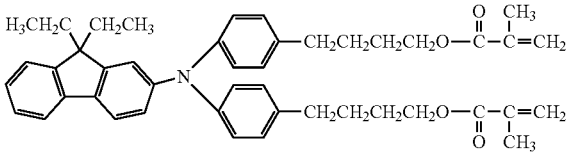
Exemplary Compound No. 1-5
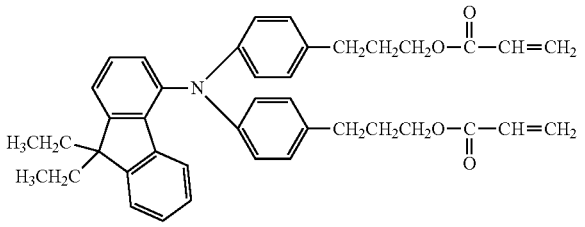
Exemplary Compound No. 1-6
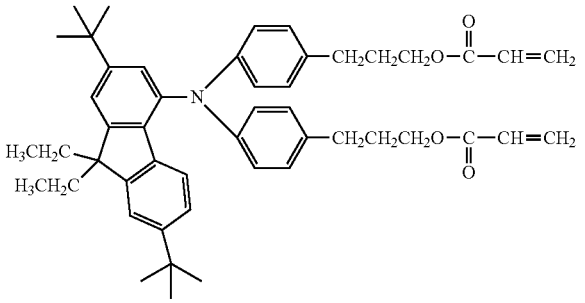
Exemplary Compound No. 1-7
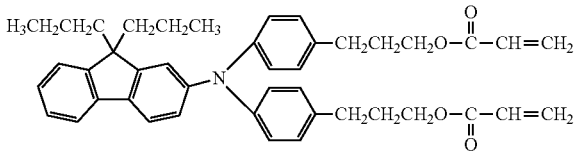
Exemplary Compound No. 1-8
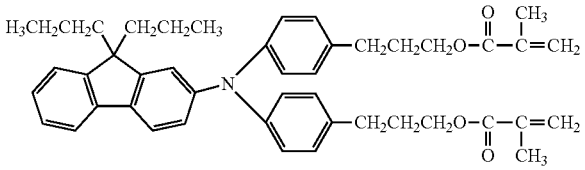
Exemplary Compound No. 1-9
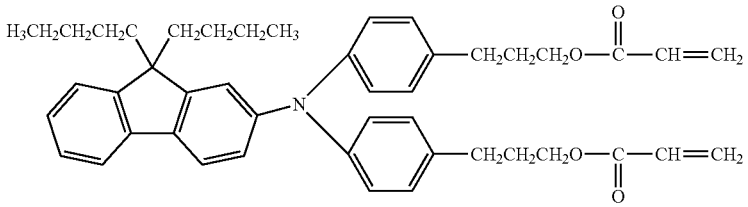
Exemplary Compound No. 1-10
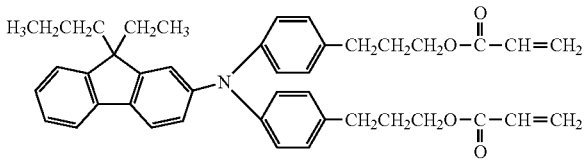
Exemplary Compound No. 1-11
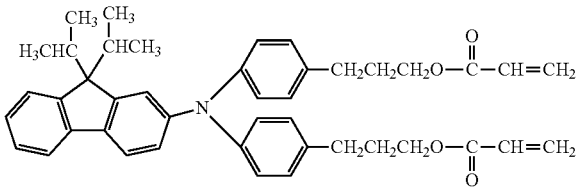
Exemplary Compound No. 1-12
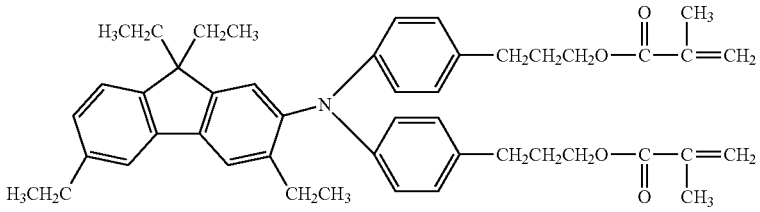

-continued
Exemplary Compound No. 1-13
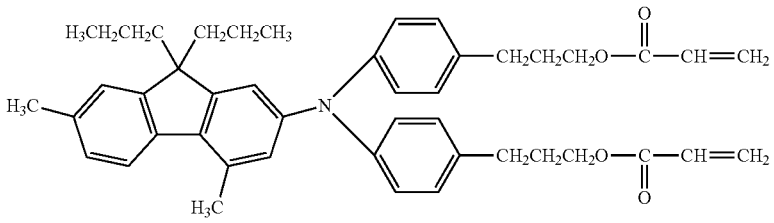
Exemplary Compound No. 1-14
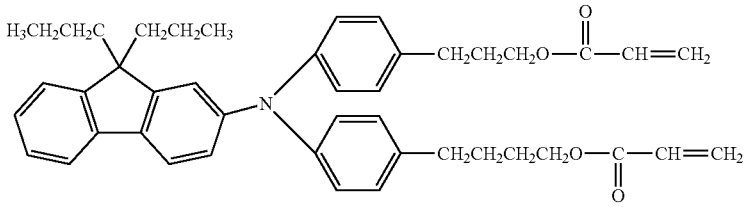
Exemplary Compound No. 1-15
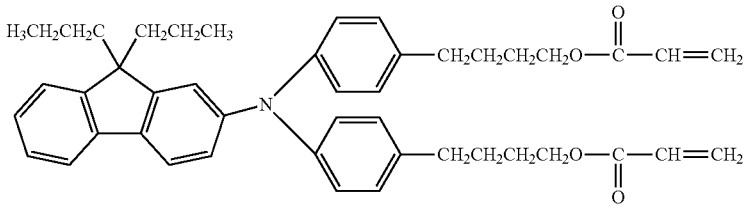
Exemplary Compound No. 1-16
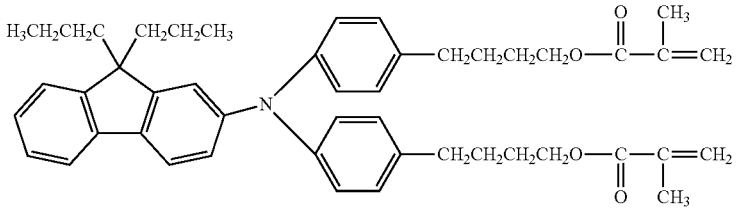
Exemplary Compound No. 1-17
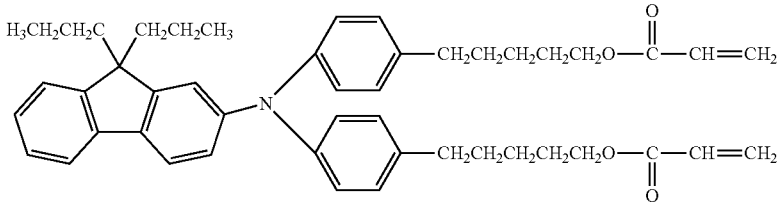
Exemplary Compound No. 1-18
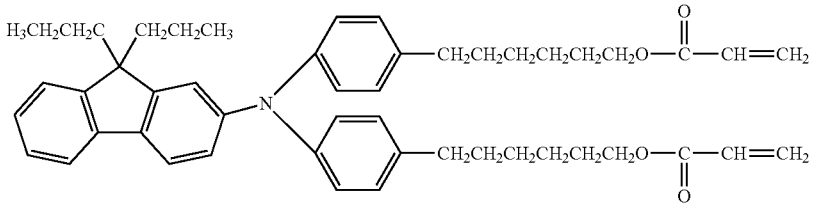
Exemplary Compound No. 1-19
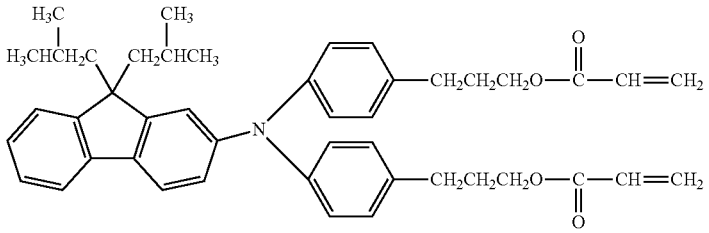

-continued
Exemplary Compound No. 1-20
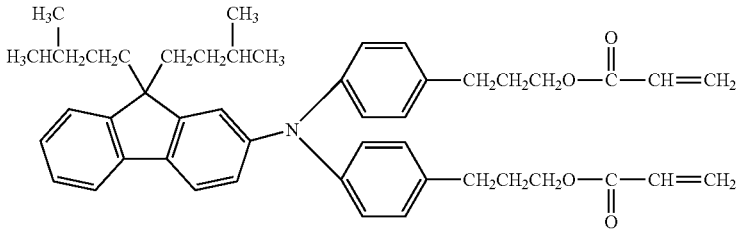
Exemplary Compound No. 1-21
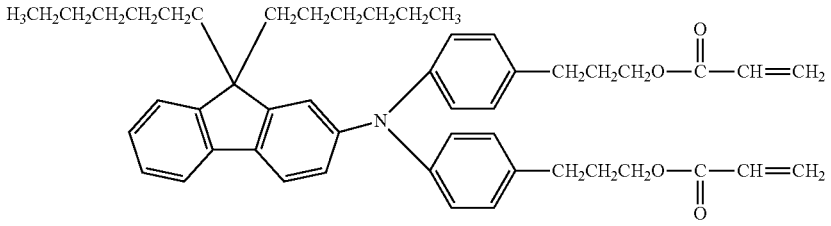
Exemplary Compound No. 1-22
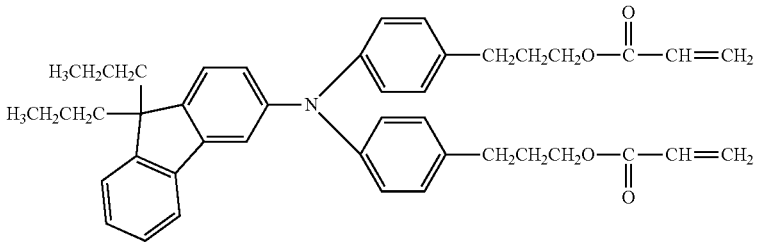
Exemplary Compound No. 1-23
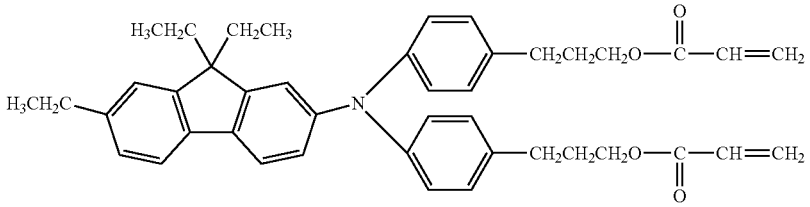
Exemplary Compound No. 1-24
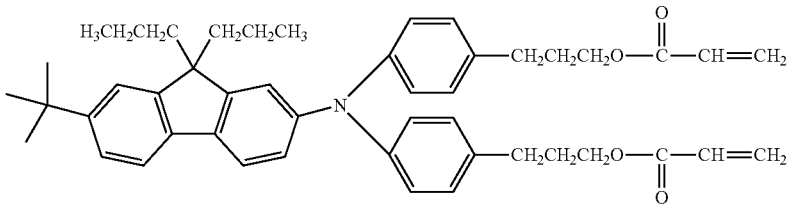
Exemplary Compound No. 1-25
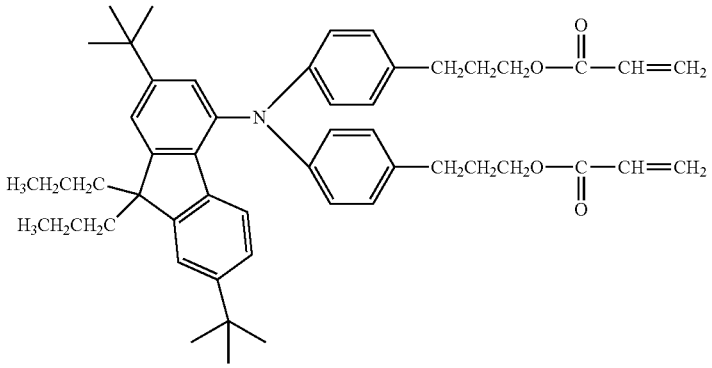

-continued

Exemplary Compound No. 1-26

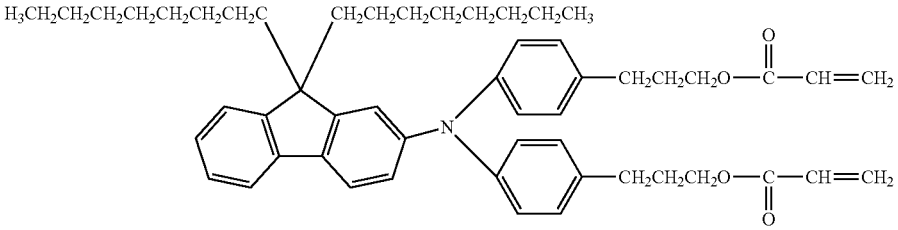

In addition, examples of the compound represented by Formula (2) are shown below. However, the compound is not limited to the following examples.

Exemplary Compound No. 2-1

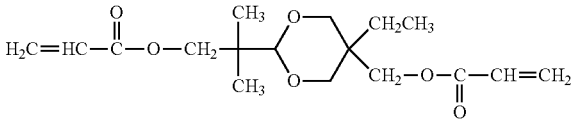

Exemplary Compound No. 2-2

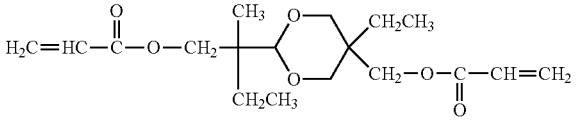

Exemplary Compound No. 2-3

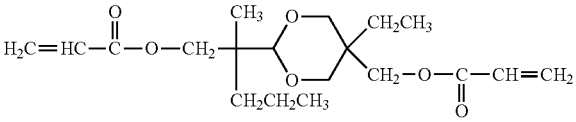

Exemplary Compound No. 2-4

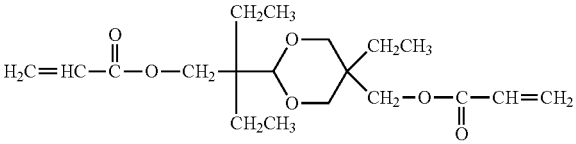

Exemplary Compound No. 2-5

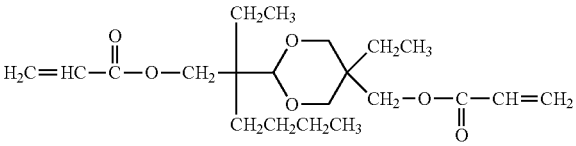

Exemplary Compound No. 2-6

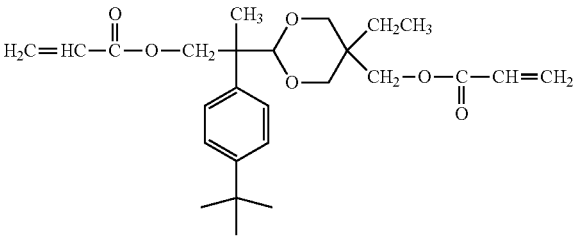

-continued

Exemplary Compound No. 2-7

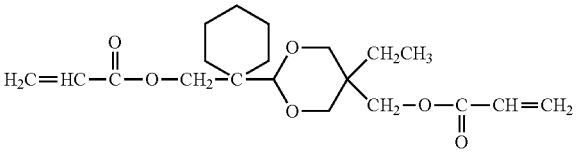

Exemplary Compound No. 2-8

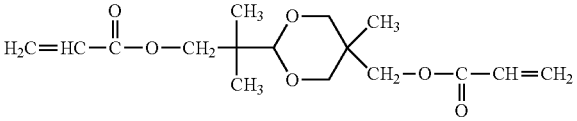

Exemplary Compound No. 2-9

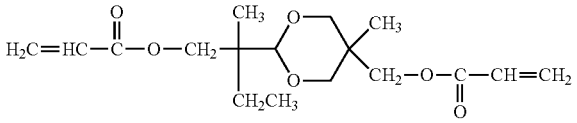

Exemplary Compound No. 2-10

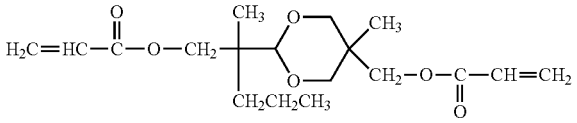

Exemplary Compound No. 2-11

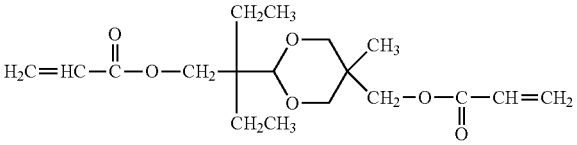

Exemplary Compound No. 2-12

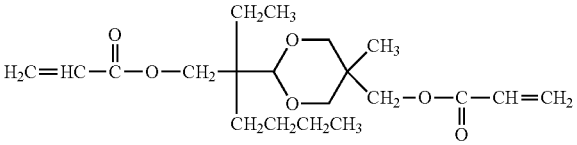

Exemplary Compound No. 2-13

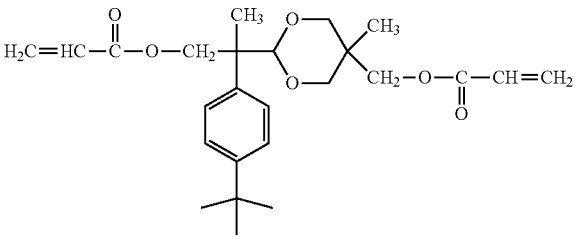

-continued

Exemplary Compound No. 2-14

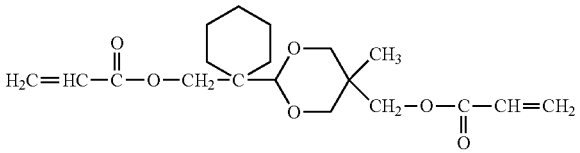

Exemplary Compound No. 2-15

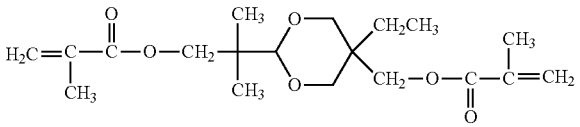

Exemplary Compound No. 2-16

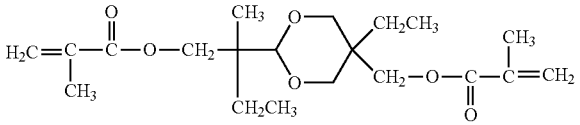

Exemplary Compound No. 2-17

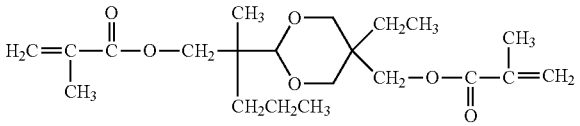

-continued

Exemplary Compound No. 2-18

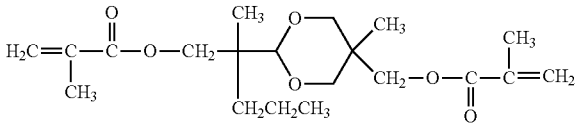

Exemplary Compound No. 2-19

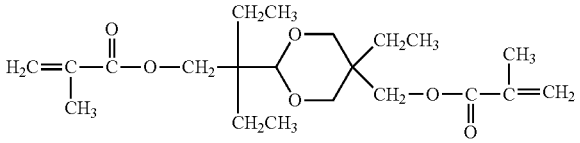

Exemplary Compound No. 2-20

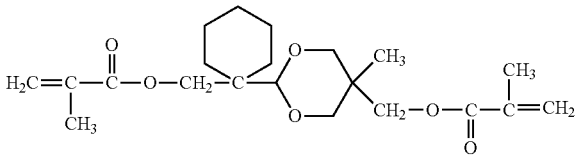

Representative synthesis examples of the compound used in the present invention are shown in the following.

Synthesis Example 1

A synthesis example of the hole transporting compound having a difunctional polymerizable acryl group represented by Exemplary Compound No. 1-7 is shown.

Reaction Formula (1)

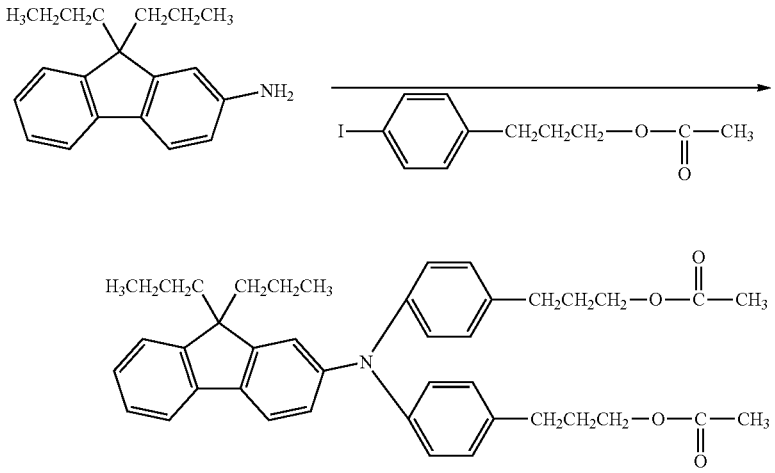

As shown in Reaction Formula (1), synthesis of a triarylamine body was carried out, using an iodine body and an amine compound. In a reaction vessel, 94.5 parts of an iodine body, 34.5 parts of an amine body in Reaction Formula (1), and 80 parts of o-dichlorobenzene were mixed, 26.9 parts of potassium carbonate and 16.6 parts of copper powder were added thereto, and stirring was performed at an internal temperature of about 210° C. for about 24 hours to perform a reaction. After the reaction, filtration, washing with toluene, and concentration were performed to obtain a crude product.

Reaction Formula (2)

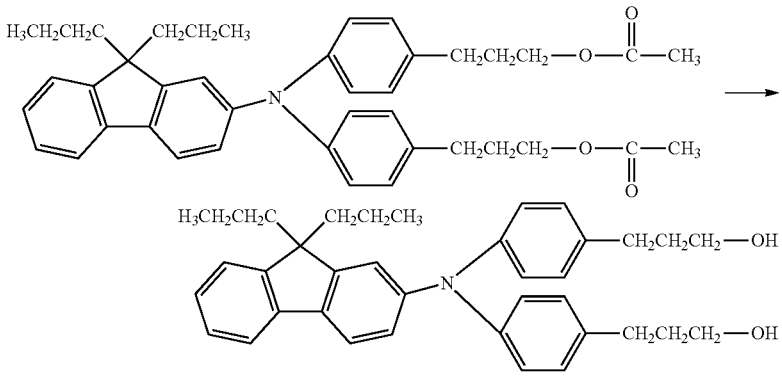

Subsequently, the entire amount of the crude product obtained in the above was used to hydrolyze the resulting intermediate to obtain a hydroxyl group from an acetic acid ester, as shown in Reaction Formula (2). The crude product obtained above was mixed with 100 parts of tetrahydrofuran, 100 parts of methanol, and 70 parts of a 24% aqueous sodium hydroxide solution, heated to an internal temperature of 60° C., stirred, and reacted for 1 hour to carry out hydrolysis. After the reaction and extraction with ethyl acetate from the reaction mixture, an organic layer was washed with water, washed with brine, dehydrated, and concentrated. Purification was performed by silica gel chromatography to obtain a dihydroxy intermediate. The quantity was 36.9 parts and the yield (after two steps of reaction) was 53.2%.

Reaction Formula (3)

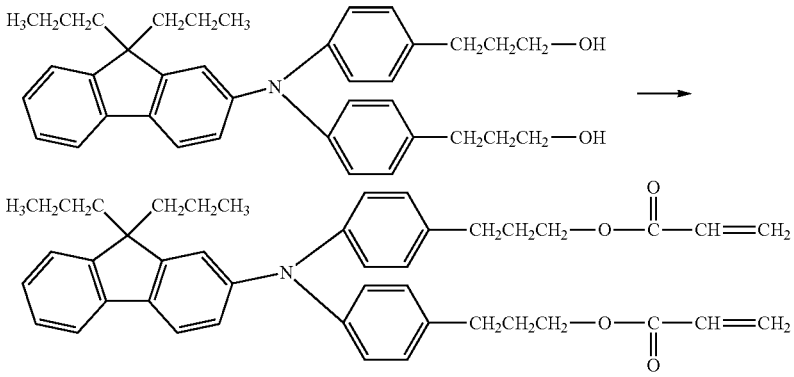

36.5 parts of the dihydroxy intermediate obtained by the reaction, 365 parts of toluene, and 0.7 parts of 4-methoxyphenol were mixed, and 11.8 parts of acrylic acid was charged into the reaction vessel. 1.3 parts of p-toluene sulfonic acid monoanhydrate was added, heating was performed under a reflux condition at 112° C. for 6 hours, and an acrylation reaction was carried out as shown in Reaction Formula (3).

After the reaction, cooling was performed, neutralization was performed using a 10% aqueous sodium hydroxide solution, and extraction was carried out with ethyl acetate. Washing with water, dehydration, and concentration were performed to obtain a crude product.

Subsequently, the crude product was purified by silica gel column chromatography to obtain a hole transporting compound having a polymerizable functional group represented by Exemplary Compound No. 1-7. The quantity was 39.5 parts and the yield was 63.0%.

Further, a varnish containing the hole transporting compound represented by Exemplary Compound No. 1-7 was obtained by adjusting the solvent type and the solvent amount of the resulting hole transporting compound. Likewise, other hole transporting compounds represented by Formula (1) can be synthesized.

Synthesis Example 2

A synthesis example of a compound having a difunctional polymerizable acryl group represented by Exemplary Compound No. 2-3 is shown.

Reaction Formula (4)

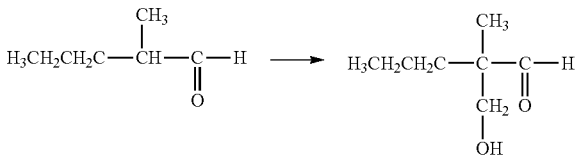

50 parts of 2-methylvaleraldehyde, 40.5 parts of 37% formaldehyde, and 8.5 parts of benzyltrimethylammonium hydroxide (a 40% aqueous solution) were mixed in an autoclave. Nitrogen gas was injected to raise pressure to 0.5 MPa, and the mixture was stirred at 90° C. for 1 hour, and the reaction was carried out as shown in Reaction Formula (4). After completion of the reaction, the reaction solution was cooled to room temperature and separated. Washing with water and concentration were carried out to obtain about 50 parts of a colorless liquid.

Reaction Formula (5)

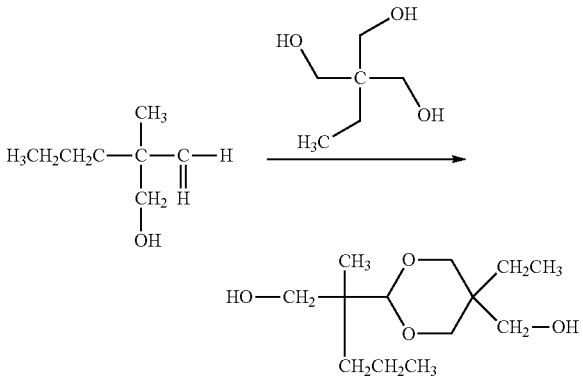

50 parts of the colorless liquid, 52 parts of trimethylolpropane, and 1 part of p-toluenesulfonic acid were mixed and stirred at room temperature overnight to carry out the reaction as shown in Reaction Formula (5). After completion of the reaction, the reaction product was purified by column chromatography using silica gel with ethyl acetate as a mobile phase to obtain about 30 parts of a colorless oil.

Reaction Formula (6)

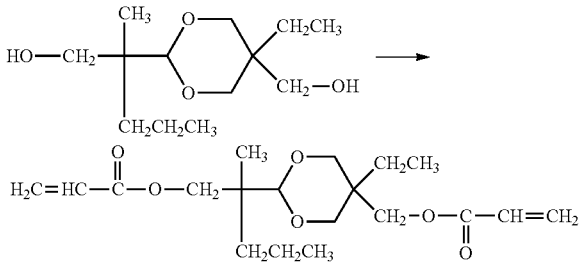

The colorless oil was subjected to dehydration condensation with acrylic acid as shown in Reaction Formula (6), using chloroform as a solvent, triethylamine as a catalyst, and dicyclohexylcarbodiimide as a dehydration condensation agent. A filtrate of the reaction product was concentrated and purified by column chromatography using silica gel with n-hexane/ethylacetate=4/1 as a mobile phase to obtain a colorless liquid. Further, 4-methoxyphenol as a polymerization inhibitor was added so that the concentration after the addition was 100 ppm, to obtain a compound having a difunctional polymerizable acrylic group represented by Exemplary Compound No. 2-3.

Likewise, other compounds represented by Formula (2) can be synthesized.

The composition for forming the surface layer of the electrophotographic photosensitive member according to an embodiment of the present invention may further contain a known hole transporting compound having a polymerizable functional group, in addition to the hole transporting compound according to the present invention, within the range of not disturbing the effect of the present invention. As the known hole transporting compound having a polymerizable functional group, an aromatic amine compound may be used.

The composition may further contain other compounds having a polymerizable functional group and not having hole transport properties. The mechanical strength of the resulting polymerization product can be further improved by using other compounds having another polymerizable functional group in combination.

The polymerizable functional group of other compounds having a polymerizable functional group and not having hole transport properties may be the above-mentioned polymerizable functional group. A radical polymerizable functional group such as a styryl group, a vinyl group, an acryloyloxy group, and a methacryloyloxy group is preferred. An acryloyloxy group or a methacryloyloxy group is more preferred.

The surface layer may include various fine particles, from a viewpoint of wear resistance. The fine particles may be inorganic fine particles or organic fine particles. As the inorganic fine particles, particles containing alumina, silica, zinc oxide, tin oxide, titanium oxide, or the like are used.

As the organic fine particles, various organic resin fine particles can be used. Examples of the organic resin fine particles include particles containing a polyolefin resin, a polytetrafluoroethylene resin, a polystyrene resin, a polyacrylic acid ester resin, a polymethacrylic acid ester resin, a polyamide resin, a polyester resin, a polyurethane resin, or the like.

A method of producing an electrophotographic photosensitive member according to an embodiment of the present invention is a method of producing an electrophotographic photosensitive member including a support and a photosensitive layer above the support. The production method includes (i) forming a coating film of a coating solution for a surface layer which is a composition containing the hole transporting compound represented by Formula (1). The production method further includes (ii) forming the surface layer of the electrophotographic photosensitive member by a polymerization reaction of the composition containing the hole transporting compound represented by Formula (1) in the coating film.

Formation of the surface layer in step (ii) can be carried out by drying and/or curing the coating film formed in step (i).

It is preferred that step (i) is forming a coating film of a coating solution for a surface layer which is a composition containing the hole transporting compound represented by Formula (1) and the compound represented by Formula (2), and step (ii) is forming the surface layer by a polymerization reaction of the composition containing the hole transporting compound represented by Formula (1) and the compound represented by Formula (2) in the coating film.

It is preferred that a content of the hole transporting compound represented by Formula (1) in the coating solution for a surface layer is 50% by mass or more with respect to the total mass of the hole transporting compound represented by Formula (1) and the compound represented by Formula (2) in the coating solution for a surface layer.

As a solvent used in the coating solution for a surface layer, an alcohol-based solvent, a sulfoxide-based solvent, a ketone-based solvent, an ether-based solvent, an ester-based solvent, an aliphatic halogenated hydrocarbon-based solvent, an aliphatic hydrocarbon-based solvent, an aromatic hydrocarbon-based solvent, or the like can be used.

Examples of a method of curing the coating film of the coating solution for a surface layer (carrying out a polymerization reaction of the composition containing the hole transporting compound according to the present invention) include methods using heat, light (such as ultraviolet rays), or radiation (such as an electron beam). Among the methods, a method using radiation is preferred, and among the radiation, an electron beam is more preferred.

When polymerization is performed using the electron beam, a highly dense (high density) three-dimensional network structure is obtained and wear resistance is improved, which is thus preferred. In addition, since the polymerization reaction becomes efficient in a short time, productivity is also increased. When the electron beam is irradiated, examples of an accelerator include a scanning type, an electro curtain type, a broad beam type, a pulse type, a laminar type, or the like.

When the electron beam is used, it is preferred that the acceleration voltage of the electron beam is 150 kV or less, from a viewpoint that deterioration of material properties by the electron beam can be suppressed without impairing polymerization efficiency. In addition, an electron beam absorption dose on the surface of the coating film of the coating solution for a surface layer is preferably 5 kGy or more and 50 kGy or less and more preferably 10 kGy or more and 30 kGy or less.

In addition, when the hole transporting compound according to the present invention is polymerized using the electron beam, for the purpose of suppressing a polymerization inhibiting action by oxygen, it is preferred that an electron beam is irradiated in an inert gas atmosphere and then heating is performed in an inert gas atmosphere. Examples of the inert gas include nitrogen, argon, helium, or the like.

Next, the entire configuration of the electrophotographic photosensitive member according to an embodiment of the present invention will be described.

<Electrophotographic Photosensitive Member>

The electrophotographic photosensitive member in the present invention has a photosensitive layer above a support. It is preferred that the photosensitive layer is a laminate type photosensitive layer in which a charge generation layer and a charge transport layer are layered in this order. If necessary, an electroconductive layer or an undercoating layer may be provided between the charge generation layer and the support, and a protection layer may be provided on the charge transport layer.

The composition for forming the surface layer of the electrophotographic photosensitive member contains the hole transporting compound according to the present invention. When the electrophotographic photosensitive member has the protection layer, the surface layer of the electrophotographic photosensitive member in the present invention refers to a protection layer, and when the electrophotographic photosensitive member does not have the protection layer, the surface layer refers to a charge transport layer if the photosensitive layer is the laminate type photosensitive layer. The photosensitive layer may be composed of a single layer type photosensitive layer containing both a charge generation material and a charge transport material, and in this case, when the electrophotographic photosensitive member has the protection layer, the surface layer refers to the photosensitive layer.

<Support>

The support is preferably an electroconductive support made of an electroconductive material. Examples of the material of the support include metals or alloys such as iron, copper, gold, silver, aluminum, zinc, titanium, lead, nickel, tin, antimony, indium, chromium, aluminum alloy, and stainless steel. In addition, a metal support or a resin support having a coating formed by vacuum deposition of aluminum, an aluminum alloy, an indium oxide-tin oxide alloy, or the like can be used. In addition, a support obtained by impregnating plastic or paper with electroconductive particles such as carbon black, tin oxide particles, titanium oxide particles, or silver particles, or a support containing an electroconductive resin can also be used. Examples of the shape of the support include cylindrical, belt-like, sheet-like, plate-like shapes, or the like, but a cylindrical shape is the most common.

The surface of the support may be subjected to treatment such as cutting treatment, roughening treatment, or alumite treatment, from a viewpoint of suppression of interference fringe by laser light scattering, improvement of surface defects of the support, improvement of conductivity of the support, or the like.

<Electroconductive Layer>

An electroconductive layer may be provided between the support and an undercoating layer or a charge generation layer described later, for the purpose of suppressing interference fringes by scattering of a laser or the like, controlling resistance, or covering a scratch of the support.

The electroconductive layer can be formed by applying a coating solution for an electroconductive layer obtained by dispersing carbon black, an electroconductive pigment, a resistance adjustment pigment, and the like with a binder resin, and drying the obtained coating film. To the coating solution for an electroconductive layer, a compound which is cured and polymerized by heating, ultraviolet irradiation, radiation irradiation, or the like may be added. The conductive layer formed by dispersing an electroconductive pigment and a resistance adjustment pigment has a surface which tends to be roughened.

A film thickness of the conductive layer is preferably 0.1 μm or more and 50 μm or less, more preferably 0.5 μm or more and 40 μm or less, and still more preferably 1 μm or more and 30 μm or less.

Examples of the binder resin used in the conductive layer include polymers and copolymers of vinyl compounds such as styrene, vinyl acetate, vinyl chloride, acrylic acid ester, methacrylic acid ester, vinylidene fluoride, or trifluoroethylene; a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, an epoxy resin, and an isocyanate resin.

Examples of the conductive pigment and the resistance adjustment pigment include particles of metal (alloy) such as aluminum, zinc, copper, chromium, nickel, silver, or stainless steel, or pigments with these particles deposited on the surface of plastic particles. In addition, particles of metal oxides such as zinc oxide, titanium oxide, tin oxide, antimony oxide, indium oxide, bismuth oxide, indium oxide doped with tin, tin oxide doped with antimony or tantalum, and the like may be also used. These may be used alone or in combination of two or more.

<Undercoating Layer>

An undercoating layer (intermediate layer) may be provided between the support or the conductive layer and the charge generation layer, for the purpose of improving adhesion of the charge generation layer, improving hole injection properties from the support, and protecting the charge generation layer against electrical breakdown.

The undercoating layer can be formed by applying a coating solution for an undercoating layer obtained by dissolving a binder resin in a solvent and drying the resulting coating film.

Examples of the binder resins used for the undercoating layer include a polyvinyl alcohol resin, a poly-N-vinylimidazole, a polyethylene oxide resin, ethyl cellulose, an ethylene-acrylic acid copolymer, casein, a polyamide resin, an N-methoxymethylated 6 nylon resin, a copolymerized nylon resin, a phenol resin, a polyurethane resin, an epoxy resin, an acrylic resin, a melamine resin, a polyester resin, or the like.

The undercoating layer may further include metal oxide particles. Examples of the metal oxide particles include particles containing titanium oxide, zinc oxide, tin oxide, zirconium oxide, or aluminum oxide. In addition, the metal oxide particles may be metal oxide particles of which the surface is treated with a surface treatment agent such as a silane coupling agent.

The thickness of the undercoating layer is preferably 0.05 μm or more and 30 μm or less, and more preferably 1 μm or more and 25 μm or less. The undercoating layer may further include organic resin particles and a leveling agent.

<Photosensitive Layer>

The photosensitive layer of the electrophotographic photosensitive member is mainly classified into (1) a laminate type photosensitive layer and (2) a single layer type photosensitive layer. (1) The laminate type photosensitive layer has a charge generation layer containing a charge generating material and a charge transport layer containing a charge transport material. (2) The single layer type photosensitive layer has a photosensitive layer containing both the charge generating material and the charge transport material.

(1) Laminate Type Photosensitive Layer

The laminate type photosensitive layer has a charge generation layer and a charge transport layer.

(1-1) Charge Generation Layer

The charge generation layer is formed by applying a coating solution for a charge generation layer obtained by dispersing a charge generating material with a binder resin and a solvent to form a coating film, and drying the resulting coating film. In addition, the charge generation layer may be a deposited film of a charge generating material.

Examples of the charge generating material used in the charge generation layer include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyes, anthanthrone pigments, pyranthrone pigments, xanthene dyes, quinoneimine dyes, styryl dyes, and the like. The charge generating material may be used alone or in combination or two or more. Among the charge generating materials, phthalocyanine pigments and azo pigments are preferred, and in particular, phthalocyanine pigments are more preferred, from a viewpoint of sensitivity.

Among the phthalocyanine pigments, particularly, oxytitanium phthalocyanine, chlorogallium phthalocyanine, and hydroxygallium phthalocyanine exhibit excellent charge generation efficiency. Further, among the hydroxygallium phthalocyanines, a hydroxygallium phthalocyanine crystal of a crystal form having a peak at Bragg angles 2θ of 7.4°±0.3° and 28.2°±0.3° in CuKα characteristic X-ray diffraction is more preferred, from a viewpoint of sensitivity.

Examples of the binder resin used in the charge generation layer include polymers of vinyl compounds such as styrene, vinyl acetate, vinyl chloride, acrylic acid ester, methacrylic acid ester, vinylidene fluoride, and trifluoroethylene, and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, an epoxy resin, and the like.

It is preferred that a mass ratio of the charge generating material to the binder resin is in a range of 1:0.3 to 1:4.

The film thickness of the charge generation layer is preferably 0.05 μm or more and 1 μm or less, and more preferably 0.1 μm or more and 0.5 μm or less.

(1-2) Charge Transport Layer

The charge transport layer can be formed by forming a coating film of a coating solution for a charge transport layer in which a charge transport material and a binder resin are mixed in a solvent and drying the coating film. When the charge transport layer is a surface layer, the coating solution for a charge transport layer which is a composition for forming a charge transport layer as a surface layer, contains the hole transporting compound according to the present invention, as described above. Hereinafter, the charge transport material and the binder resin used in the charge transport layer will be described.

Examples of the charge transport material include carbazole compounds, hydrazone compounds, N,N-dialkylaniline compounds, diphenylamine compounds, triphenylamine compounds, triphenylmethane compounds, pyrazoline compounds, styryl compounds, stilbene compounds, and the like.

Examples of the binder resin include acrylic acid ester, methacrylic acid ester, a polyvinyl alcohol resin, a polyvinyl acetal resin, a polycarbonate resin, a polyester resin, and the like. In addition, curable resins such as a curable phenolic resin, a curable urethane resin, a curable melamine resin, a curable epoxy resin, a curable acrylic resin, and a curable methacrylic resin can be used.

Examples of the solvent used in the coating solution for a charge transport layer include an alcohol-based solvent, a sulfoxide-based solvent, a ketone-based solvent, an ether-based solvent, an ester-based solvent, an aliphatic halogenated hydrocarbon-based solvent, an aromatic hydrocarbon-based solvent, and the like.

When the charge transport layer is a surface layer, it is preferred that a film thickness of the charge transport layer is 5 μm or more and 40 μm or less.

When the charge transport layer is not a surface layer, a film thickness of the charge transport layer is preferably 1 μm or more and 100 μm or less, more preferably 3 μm or more and 50 μm or less, and still more preferably 5 μm or more and 40 μm or less.

(2) Single Layer Type Photosensitive Member

The photosensitive layer of the single layer type photosensitive member can be formed by preparing a coating solution for a photosensitive layer containing a charge generating material, charge transport material, a resin, and a solvent, forming the coating film thereof, and drying the coating film. Examples of the charge generating material, the charge transport material, and the resin are the same as the examples of the materials in the above "(1) laminate type photosensitive layer".

When the single layer type photosensitive member does not have a protection layer, the photosensitive layer of the single layer type photosensitive member is the surface layer in the present invention. That is, the coating solution for a photosensitive layer, which is a composition for forming a photosensitive layer as a surface layer, contains the hole transporting compound according to the present invention. It is preferred that a film thickness of the photosensitive layer of the single layer type photosensitive member is 5 μm or more and 40 μm or less. When the single layer type photosensitive member has a protection layer, the protection layer is the surface layer in the present invention. The coating solution for a protection layer, which is a composition for forming a protection layer as a surface layer, contains the hole transporting compound of the present invention.

<Protection Layer>

The electrophotographic photosensitive member according to an embodiment of the present invention may have a protection layer on the photosensitive layer. When the electrophotographic photosensitive member has a protection layer, the protection layer is the surface layer in the present invention.

As described above, the coating solution for a protection layer, which is a composition for forming a protection layer as a surface layer, contains the hole transporting compound according to the present invention.

Examples of a reaction method for forming the protection layer include a thermal polymerization reaction, a photopolymerization reaction, a radiation polymerization reaction, and the like.

The protection layer may include an additive such as an antioxidant, an ultraviolet light absorber, a plasticizer, a leveling agent, a sliding property imparting agent, and an abrasion resistance improver.

Specifically, examples of the additive include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, boron nitride particles, and the like.

The protection layer may include conductive particles and/or a charge transport material and a resin, in a range of not impairing the effect of the present invention.

Examples of the conductive particles include particles of metal oxides such as titanium oxide, zinc oxide, tin oxide, and indium oxide.

Examples of the charge transport material include a benzidine compound, a triarylamine compound, and the like.

Examples of the resin include a polyester resin, an acryl resin, a phenoxy resin, a polycarbonate resin, a polystyrene resin, a phenol resin, a melamine resin, an epoxy resin, and the like. Among them, a polycarbonate resin, a polyester resin, and an acryl resin are preferred.

It is preferred that a film thickness of the protection layer is 0.5 μm or more and 20 μm or less.

The protection layer can be formed by preparing a coating solution for a protection layer containing each of the above materials and a solvent, forming the coating film thereof, and drying and/or curing the coating film. Examples of the solvent used in the coating solution include an alcohol-based solvent, a ketone-based solvent, an ether-based solvent, a sulfoxide-based solvent, an ester-based solvent, an aromatic hydrocarbon-based solvent, and the like.

It is possible to add various additives to each layer of the electrophotographic photosensitive member of the present invention. Specifically, examples of the additive include an organic pigment, an organic dye, a coating film surface adjusting agent, an electron transport agent, oil, wax, an antioxidant, a light absorber, a polymerization initiator, a radical deactivator, organic resin fine particles, inorganic particles, and the like.

On the surface of each layer of the electrophotographic photosensitive member, surface processing may be performed using a polishing sheet, a shape transfer type member, glass beads, zirconia beads, and the like. In addition, concave and convex portions may be formed on the surface using a constituent material of the coating solution. When the coating solution of each of the layers is applied, any known coating method such as a dip coating method, a spray coating method, a circular amount regulation (ring) coating method, a spin coating method, a roller coating method, a Meyer bar coating method, and a blade coating method can be used.

Next, a process cartridge and an image formation process according to an embodiment of the present invention will be described.

The process cartridge according to an embodiment of the present invention supports the electrophotographic photosensitive member according to an embodiment of the present invention integrally with at least one unit selected from the group consisting of a charging unit, a developing unit, a transfer unit, and a cleaning unit, and is detachably attachable to an electrophotographic apparatus main body.

An example of the configuration of the process cartridge according to an embodiment of the present invention is illustrated in FIG. 1. In FIG. 1, a cylindrical electrophotographic photosensitive member 1 is rotationally driven at a predetermined circumferential speed in an arrow direction. A circumferential surface of the rotationally driven electrophotographic photosensitive member 1 is uniformly charged to a positive or negative predetermined potential by a charging unit 2. Next, the charged circumferential surface of electrophotographic photosensitive member 1 receives exposure light (image exposure light) 3 output from an exposing unit (not illustrated) such as slit exposure or laser beam scanning exposure. Thus, an electrostatic latent image corresponding to a target image is sequentially formed on the circumferential surface of the electrophotographic photosensitive member 1. As a voltage applied to the charging unit (charging roller or the like) 2, either of a voltage obtained by superimposing an alternating current component on a direct current component or a voltage having only a direct current component may be used.

The electrostatic latent image formed on the circumferential surface of the electrophotographic photosensitive member 1 is developed by a toner contained in a developer of a developing unit 4 to form a toner image. Subsequently, the toner image formed and carried on the circumferential surface of the electrophotographic photosensitive member 1 is sequentially transferred from a transfer unit 5 (transfer roller or the like) to a transfer material 6 (paper, an intermediate transfer body, or the like) by a transfer bias. The transfer material 6 is fed in synchronization with a rotation of the electrophotographic photosensitive member 1.

After de-electrification by pre-exposure light 7 from a pre-exposing unit (not illustrated), the surface of the electrophotographic photosensitive member 1 is cleaned by removing the transfer residual toner by the cleaning unit 8, and the electrophotographic photosensitive member 1 is repeatedly used for image formation. The pre-exposing unit may be before or after the cleaning step, and the pre-exposing unit is not necessarily required.

The electrophotographic photosensitive member 1 may be mounted on an electrophotographic apparatus such as a copying machine or a laser beam printer. In addition, a process cartridge 9 which is configured by storing a plurality of elements among the constituent elements such as the electrophotographic photosensitive member 1, the charging unit 2, the developing unit 4, and the cleaning unit 8 in a container and integrally supporting the elements may be configured to be detachably attachable to an electrophotographic apparatus main body. In FIG. 1, the process cartridge 9 integrally supports the electrophotographic photosensitive member 1, the charging unit 2, the developing unit 4, and the cleaning unit 8 and is detachably attachable to the electrophotographic apparatus main body.

Next, the electrophotographic apparatus according to an embodiment of the present invention will be described.

The electrophotographic apparatus according to an embodiment of the present invention includes the electrophotographic photosensitive member according to an embodiment of the present invention, a charging unit, an exposing unit, a developing unit, and a transfer unit.

Figure 2:
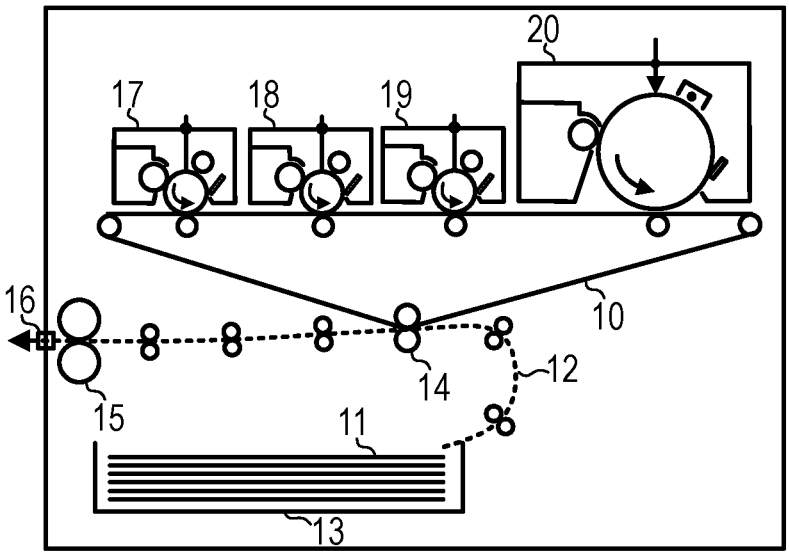
FIG. 2 is a schematic diagram illustrating an example of an electrophotographic apparatus having the electrophotographic photosensitive member.

An example of the configuration of the electrophotographic apparatus according to an embodiment of the present invention is illustrated in FIG. 2. Yellow, magenta, cyan, black, a process cartridge for yellow 17, a process cartridge for magenta 18, a process cartridge for cyan 19, and a process cartridge for black 20, which correspond to each color, are provided in parallel along an intermediate transfer member 10. As illustrated in FIG. 2, it is not necessary to unify the diameter, constituent materials, developer, charging method, and other unit of the electrophotographic photosensitive member. For example, in the electrophotographic apparatus of FIG. 2, the diameter of the electrophotographic photosensitive member for black is larger than the diameters of the electrophotographic photosensitive member for other colors (yellow, magenta, and cyan). In addition, while a charging method for other colors is a method of applying a voltage in which an alternating current component is superimposed on a direct current component, a charging method for black adopts a method of using corona discharge.

When an image forming operation is started, the toner image of each color is sequentially superimposed on the intermediate transfer member 10, following the above-described image forming process. At the same time, a transfer paper 11 is fed from a paper feed tray 13 by a paper feed path 12 and is fed to a secondary transfer unit 14 in timing with the rotational operation of the intermediate transfer member 10. The toner image on the intermediate transfer member 10 is transferred to the transfer paper 11 by a transfer bias from the secondary transfer unit 14. The toner image transferred on the transfer paper 11 is conveyed along the paper feed path 12, fixed on the transfer paper by a fixing unit 15, and discharged from a paper discharge unit 16.

According to the present invention, there is provided an electrophotographic photosensitive member which has wear resistance, suppresses smeared image under a high temperature and high humidity environment, and also, has a small potential fluctuation when repeatedly used under a low temperature and low humidity environment. In addition, an electrophotographic apparatus equipped with the electrophotographic photosensitive member is provided. Further, a process cartridge equipped with the electrophotographic photosensitive member is provided. Further, a method of producing the electrophotographic photosensitive member is provided.

EXAMPLES

Hereinafter, the present invention will be described in more detail by way of specific examples. In the Examples, "parts" means "parts by mass". In addition, an electrophotographic photosensitive member is hereinafter also simply referred to as "a photosensitive member".

<Manufacture of Electrophotographic Photosensitive Member>

Example 1

A cylindrical aluminum cylinder having an outer diameter of 30.0 mm, a length of 357.5 mm, and a thickness of 0.7 mm was used as a support (electroconductive support).

Next, 10 parts of zinc oxide particles (specific surface area: 19 $m^2/g$, powder resistivity: $4.7\times10^6$ Ω·cm) were mixed with stirring with 50 parts of toluene, and 0.08 parts of a silane coupling agent was added thereto and stirred for 6 hours. Thereafter, toluene was distilled off under reduced pressure, and the residue was dried by heating at 130° C. for 6 hours, and surface-treated zinc oxide particles were obtained. As the silane coupling agent, KBM 602 (compound name: N-2-(aminoethyl)-3-aminopropylmethyldimethoxysilane) manufactured by Shin-Etsu Chemical Co., Ltd. was used.

Next, 15 parts of a polyvinylbutyral resin (weight average molecular weight: 40000, product name: BM-1, manufactured by Sekisui Chemical Company, Limited) and 15 parts of blocked isocyanate (product name: Duranate TPA-B80E, manufactured by Asahi Kasei Chemicals Corp.) were prepared. These were dissolved in a mixed solution of 73.5 parts of methylethyl ketone and 73.5 parts of 1-butanol. 80.8 parts of the surface-treated zinc oxide particles and 0.8 parts of 2,3,4-trihydroxybenzophenone (manufactured by Wako Pure Chemical Industries, Ltd.) were added to the solution, and dispersed under an atmosphere at 23±3° C. for 3 hours by a sand mill using glass beads having a diameter of 0.8 mm. After dispersion, 0.01 parts of silicone oil (product name: SH28PA, manufactured by Dow Corning Toray Co., Ltd.), 5.6 parts of crosslinked polymethyl methacrylate (PMMA) particles (product name: TECHPOLYMER SSX-102, manufactured by Sekisui Plastics Co., Ltd., average primary diameter of 2.5 μm) were added and stirred to prepare a coating solution for an undercoating layer.

The coating solution for an undercoating layer was dip-coated on the support to form a coating film, and the resulting coating film was dried at 160° C. for 40 minutes to form an undercoating layer having a film thickness of 18 μm.

Next, 2 parts of a hydroxygallium phthalocyanine crystal (charge generating material) in a crystalline form having peaks at 7.4° and 28.2° with a Bragg angle of 20±0.2 in CuKα characteristic X-ray diffraction were prepared. Further, 0.02 parts of a calixarene compound represented by the following Structural Formula (A), 1 part of polyvinyl butyral (product name: S-LEC BX-1, manufactured by Sekisui Chemical Co., Ltd.), and 60 parts of cyclohexanone were prepared. These were placed in a sand mill using glass beads having a diameter of 1 mm, and dispersed for 4 hours. Thereafter, 70 parts of ethyl acetate was added to prepare a coating solution for a charge generation layer. The coating solution for a charge generation layer was dip-coated on the undercoating layer, and the resulting coating film was dried at 90° C. for 15 minutes to form a charge generation layer having a film thickness of 0.17μm.

(A)

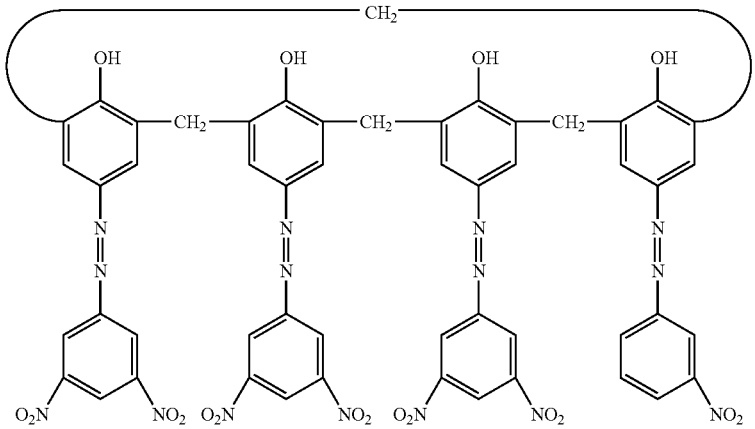

Next, the following materials were prepared.

- 6 parts of a compound represented by the following Structural Formula (B)
- 3 parts of a compound represented by the following Structural Formula (C)
- 1 part of a compound represented by the following Structural Formula (D)
- 10 parts of a bisphenol Z type polycarbonate resin (product name: Iupilon Z400, manufactured by Mitsubishi Engineering-Plastics Corporation)

These were dissolved in a mixed solvent of 35 parts of o-xylene, 35 parts of dimethoxymethane, and 30 parts of methyl benzoate to prepare a coating solution for a charge transport layer. The coating solution for a charge transport layer was dip-coated on the charge generation layer, and the resulting coating film was dried at 110° C. for 50 minutes, thereby forming a charge transport layer having a film thickness of 18μm.

(B)

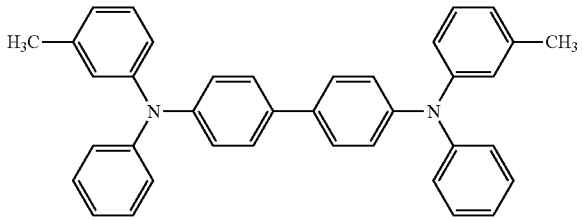

(C)

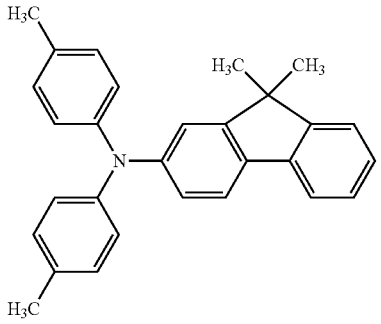

-continued (D)

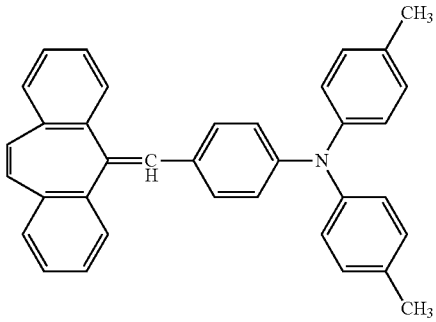

1.5 parts of a fluorine atom-containing acryl resin having a repeating structural unit represented by the following Formula (F1) and a repeating structural unit represented by the following Formula (F2) (weight average molecular weight: 83,000, copolymerization ratio (F1)/(F2)=1/1 (molar ratio)):

(F1)

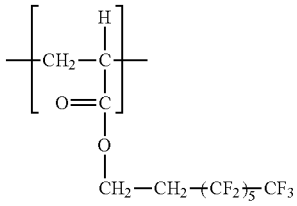

(F2)

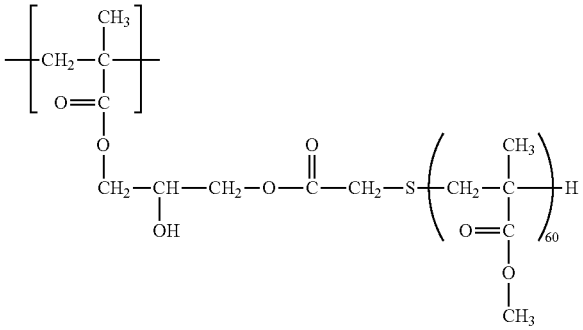

was dissolved in a mixed solvent of 45 parts of 1-propanol and 45 parts of ZEORORA H (manufactured by Zeon Corporation). Thereafter, 30 parts of fluorinated ethylene resin powder (product name: Lubron L-2, manufactured by DAIKIN INDUSTRIES, Ltd.) was added, and dispersion was performed with a high pressure disperser (product name: Microfluidizer M-110EH, manufactured by Microfluidics Corporation, US) to obtain a fluorinated ethylene resin dispersion.

4 parts of the hole transporting compound represented by Exemplary Compound No. 1-1, 8 parts of the fluorinated ethylene resin dispersion, 3 parts of 1-propanol, and 3 parts of ZEORORA H were stirred and uniformly dispersed to prepare a coating solution for a protection layer.

The coating solution for a protection layer was dip-coated on the charge transport layer, the resulting coating film was dried at 50° C. for 10 minutes, and polymerization curing treatment was carried out by electron beam irradiation and heating under the following conditions.

Under an atmosphere with an oxygen concentration of 50 ppm or less, an electron beam was irradiated under the conditions of an irradiation distance of 30 mm, an acceleration voltage of 70 kV, a beam current of 8 mA, and an irradiation time of 3.0 seconds, using an electron beam irradiation apparatus, while the aluminum cylinder was rotated at a speed of 300 rpm. After electron beam irradiation, the surface of the protection layer coating film was allowed to reach 135° C. for 24 seconds, rapidly using an induction heating device, under the same condition of an oxygen concentration of 50 ppm or less.

Next, the above-described aluminum cylinder was taken out to the atmosphere and further heated at 100° C. for 12 minutes, thereby forming a protection layer having a film thickness of 5 μm.

Next, a die member (mold) was installed in a pressure pattern transferring apparatus, and surface processing was performed on the manufactured electrophotographic photosensitive member before forming a concave portion.

Figure 3:
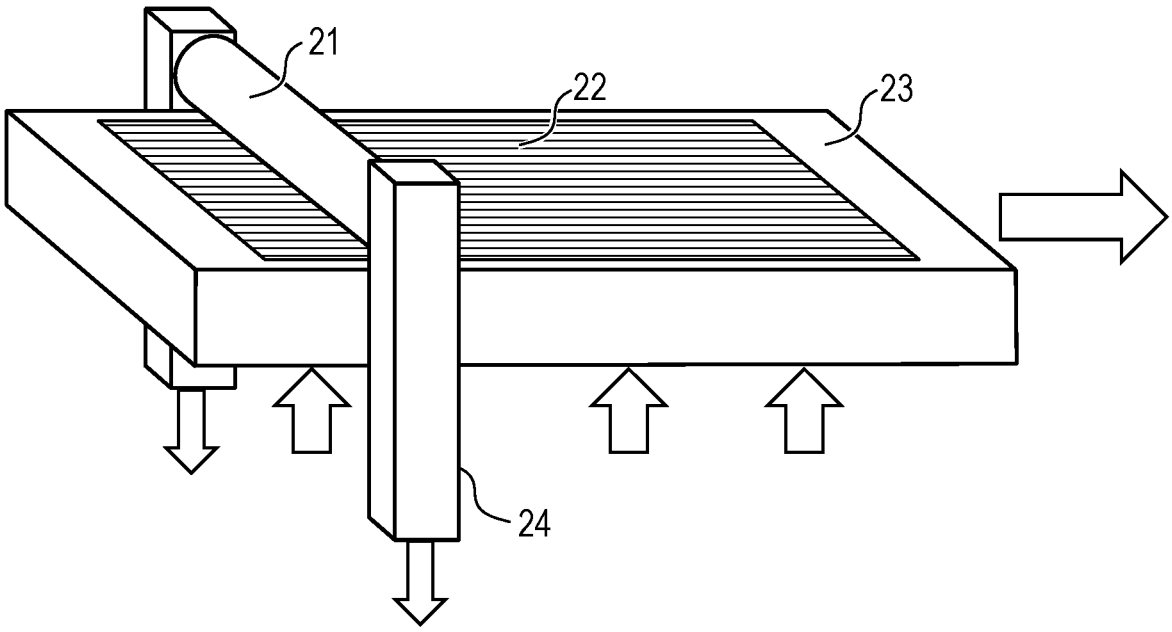
FIG. 3 is a drawing illustrating an example of a pressure pattern transferring apparatus for forming a concave portion on a circumferential surface of the electrophotographic photosensitive member.
Figure 4A:
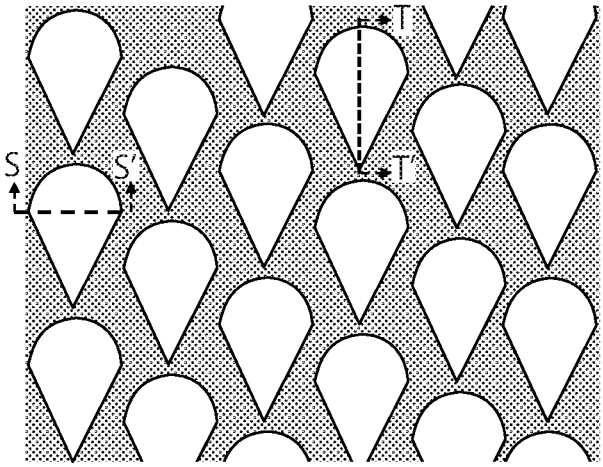
FIG. 4A is a top view illustrating the outline of a mold.
Figure 4B:
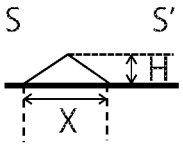
FIG. 4B is a schematic cross-sectional view in an axial direction of the electrophotographic photosensitive member of a convex portion of the mold (a cross-sectional view in S-S' section of FIG. 4A).
Figure 4C:
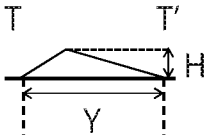
FIG. 4C is a cross-sectional view in a circumferential direction of the electrophotographic photosensitive member of the convex portion of the mold (a cross-sectional view in T-T' section of FIG. 4A).

Specifically, a mold illustrated in FIGS. 4A to 4C was installed in a pressure pattern transferring apparatus of a configuration having a mold 22, a pressurizing member 23, and a support member 24 which is generally illustrated in FIG. 3, and surface processing was performed on the manufactured electrophotographic photosensitive member 21 before forming the concave portion. FIGS. 4A to 4C are drawings illustrating a mold used in the Examples and the Comparative Examples. FIG. 4A is a top view illustrating an outline of a mold, and FIG. 4B is a schematic cross-sectional view in an axial direction of the electrophotographic photosensitive member 21 of a convex portion of the mold (a cross-sectional view in S-S' section of FIG. 4A). FIG. 4C is a cross-sectional view in a circumferential direction of the electrophotographic photosensitive member 21 of the convex portion of the mold (a cross-sectional view in T-T' section of FIG. 4A). The mold illustrated in FIGS. 4A to 4C has a convex portion having a maximum width (a maximum width in an axial direction of the electrophotographic photosensitive member 21 when the convex portion on the mold is viewed from above) X: 50 μm, a maximum length (a maximum length in a circumferential direction of the electrophotographic photosensitive member 21 when the convex portion on the mold is viewed from above) Y: 75 μm, an area ratio of 56%, and a height H: 4 μm. The area ratio refers to a ratio of an area of the convex portion occupied on the entire area when the mold is viewed from above. At the time of processing, the temperature of the electrophotographic photosensitive member 21 and the mold was controlled so that the surface temperature of the electrophotographic photosensitive member 21 was 120° C. Then, the electrophotographic photosensitive member 21 was rotated in a circumferential direction to form a concave portion on the entire surface layer (circumferential surface) of the electrophotographic photosensitive member 21, while the electrophotographic photosensitive member and the pressurizing member were pressed against the mold at a pressure of 7.0 MPa. Thus, the electrophotographic photosensitive member 21 was manufactured.

The surface of the resulting electrophotographic photosensitive member 21 was observed by magnification with a 50× lens with a laser microscope (product name: X-100, manufactured by KEYENCE CORPORATION), so that the concave portion provided on the surface of the electrophotographic photosensitive member 21 was observed. At the time of observation, an adjustment was performed so that there is no inclination in a longitudinal direction of the electrophotographic photosensitive member 21 and in a circumferential direction, the apex of the arc of the electrophotographic photosensitive member 21 was in focus. The image subjected to observation by magnification was connected by an image connection application to obtain a square area of 500 μm on a side. Then, for the obtained result, the image processing height data was selected with an attached image analysis software, and the filter processing was performed by a filter type median.

As a result of the observation, the depth of the concave portion was 2 μm, a width of an opening in an axial direction was 50 μm, a length of the opening in a circumferential direction was 75 and an area was 140000 $\mu m^2$. The area is the area of the concave portion when the surface of the electrophotographic photosensitive member 21 is viewed from above, and means the area of the opening of the concave portion.

The photosensitive member according to Example 1 was manufactured as described above.

Examples 2 to 11 and Comparative Examples 1 to 8

Hole transporting compounds shown in Table 1 were used respectively instead of the hole transporting compound used in the preparation of the coating solution for a protection layer in Example 1. Other than that, the photosensitive members according to Examples 2 to 11 and Comparative Examples 1 to 8 were manufactured in the same manner as in Example 1. Comparative Compounds Nos. 1 to 8 used in Comparative Examples 1 to 8 are shown.

Comparative Compound No. 1

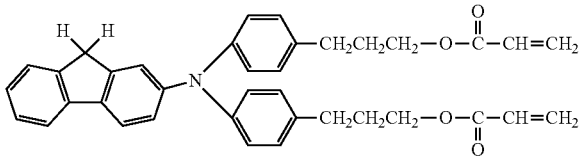

Comparative Compound No. 2

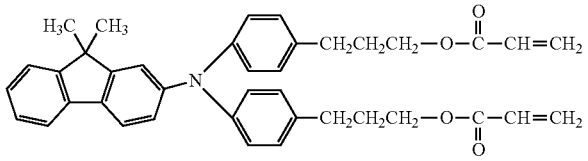

Comparative Compound No. 3

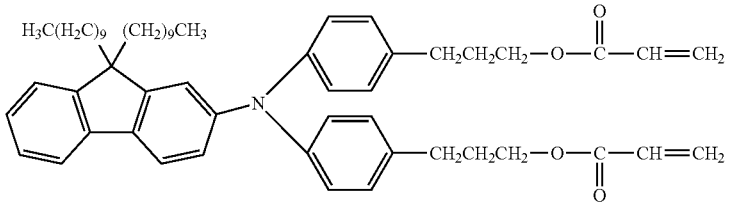

Comparative Compound No. 4

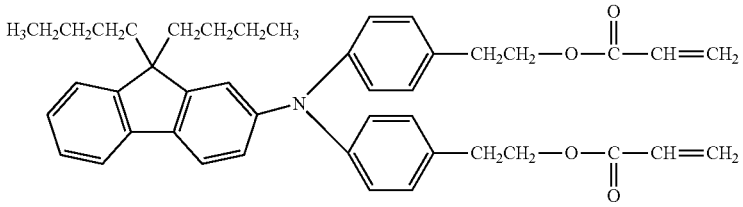

Comparative Compound No. 5

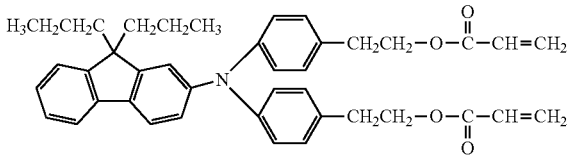

Comparative Compound No. 6

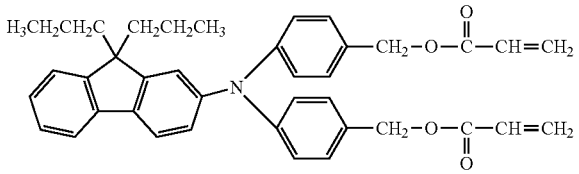

Comparative Compound No. 7

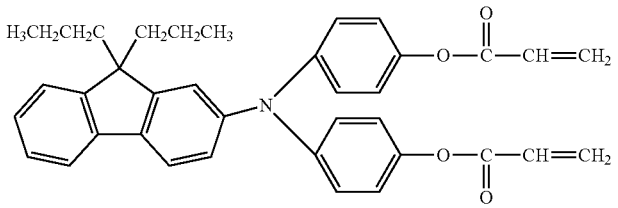

Comparative Compound No. 8

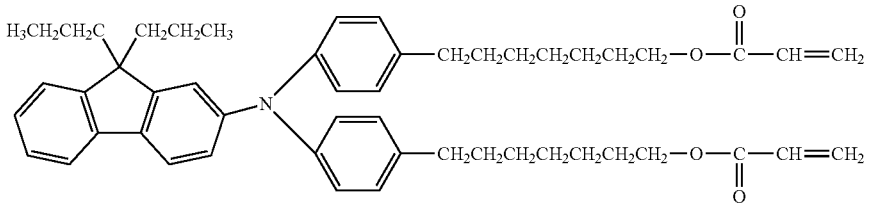

Examples 12 to 18

Hole transporting compounds in types and amounts shown in Table 1, respectively and the compound represented by Formula (2) were used instead of the hole transporting compound used in the preparation of the coating solution for a protection layer in Example 1. Other than that, the photosensitive members according to Examples 12 to 18 were manufactured in the same manner as in Example 1.

Comparative Example 9

An electrophotographic photosensitive member was manufactured in the same manner as in Example 1, except that the protection layer was formed as follows.

A coating solution for a protection layer was prepared by dissolving 4 parts of the compound represented by the following Comparative Compound No. 9 in 100 parts of tetrahydrofuran. The coating solution for a protection layer was spray-coated on a charge transport layer, dried, and curing-polymerized under the same conditions as in Example 1 to form a protection layer.

Comparative Compound No. 9

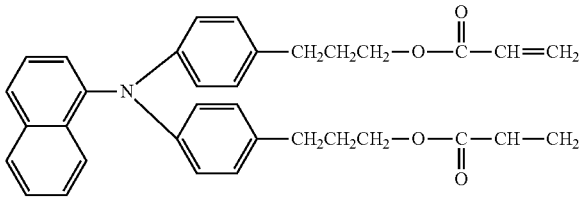

Comparative Example 10

An electrophotographic photosensitive member was manufactured in the same manner as in Example photosensitive member 1, except that the protection layer was formed as follows.

First, the following materials were prepared.

1 part of a compound represented by the following Comparative Compound No. 10, 1 part of trimethylolpropane triacrylate, 0.2 parts of 1-hydroxycyclohexylphenyl ketone as a polymerization initiator, and 0.2 parts of 2,2-bis(4,4-di-t-butylperoxycyclohexyl) propane, 58 parts of tetrahydrofuran as a coating material solvent These were mixed to prepare a coating solution for a protection layer. The coating solution for a protection layer was spray-coated on a charge hole transport layer, dried, and curing-polymerized under the same conditions as in the photosensitive member of Example 1 to form a protection layer.

Comparative Compound No. 10

Comparative Compound No. 10

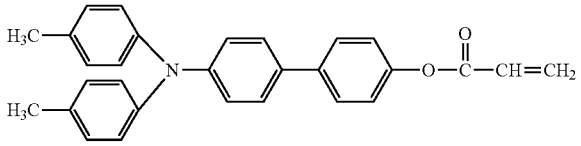

<Calculation of Energy Value of HOMO>

For the hole transporting compound used in Examples 1 to 18 and Comparative Examples 1 to 8, the energy value of HOMO was calculated by a density functional theory method (B3LYP/6-31G*). The results are shown in Table 1.

TABLE 1

| | Hole transporting compound | Used amount (part) of hole transporting compound | Compound represented by Formula (2) | Used amount (part) of compound represented by Formula (2) | Hole transporting compound HOMO value (eV) |
|---|---|---|---|---|---|
| Example 1 | Exemplary Compound No. 1-1 | 4 | — | — | −4.87 |
| Example 2 | Exemplary Compound No. 1-3 | 4 | — | — | −4.89 |
| Example 3 | Exemplary Compound No. 1-7 | 4 | — | — | −4.87 |
| Example 4 | Exemplary Compound No. 1-8 | 4 | — | — | −4.84 |
| Example 5 | Exemplary Compound No. 1-9 | 4 | — | — | −4.86 |
| Example 6 | Exemplary Compound No. 1-15 | 4 | — | — | −4.89 |
| Example 7 | Exemplary Compound No. 1-17 | 4 | — | — | −4.81 |
| Example 8 | Exemplary Compound No. 1-18 | 4 | — | — | −4.81 |
| Example 9 | Exemplary Compound No. 1-20 | 4 | — | — | −4.86 |
| Example 10 | Exemplary Compound No. 1-21 | 4 | — | — | −4.86 |
| Example 11 | Exemplary Compound No. 1-26 | 4 | — | — | −4.87 |
| Example 12 | Exemplary Compound No. 1-1 | 2.8 | Exemplary Compound No. 2-1 | 1.2 | −4.87 |
| Example 13 | Exemplary Compound No. 1-7 | 2.8 | Exemplary Compound No. 2-1 | 1.2 | −4.87 |
| Example 14 | Exemplary Compound No. 1-7 | 2.4 | Exemplary Compound No. 2-1 | 1.6 | −4.87 |
| Example 15 | Exemplary Compound No. 1-7 | 2 | Exemplary Compound No. 2-1 | 2 | −4.87 |
| Example 16 | Exemplary Compound No. 1-7 | 2.8 | Exemplary Compound No. 2-3 | 1.2 | −4.87 |
| Example 17 | Exemplary Compound No. 1-7 | 2.8 | Exemplary Compound No. 2-4 | 1.2 | −4.87 |
| Example 18 | Exemplary Compound No. 1-7 | 2.8 | Exemplary Compound No. 2-7 | 1.2 | −4.87 |
| Comparative Example 1 | Comparative Compound No. 1 | 4 | — | — | −4.89 |
| Comparative Example 2 | Comparative Compound No. 2 | 4 | — | — | −4.88 |
| Comparative Example 3 | Comparative Compound No. 3 | 4 | — | — | −4.86 |
| Comparative Example 4 | Comparative Compound No. 4 | 4 | — | — | −5.05 |
| Comparative Example 5 | Comparative Compound No. 5 | 4 | — | — | −5.05 |
| Comparative Example 6 | Comparative Compound No. 6 | 4 | — | — | −5.02 |

TABLE 1-continued

| | Hole transporting compound | Used amount (part) of hole transporting compound | Compound represented by Formula (2) | Used amount (part) of compound represented by Formula (2) | Hole transporting compound HOMO value (eV) |
|---|---|---|---|---|---|
| Comparative Example 7 | Comparative Compound No. 7 | 4 | — | — | −4.84 |
| Comparative Example 8 | Comparative Compound No. 8 | 4 | — | — | −4.71 |
| Comparative Example 9 | Comparative Compound No. 9 | 4 | — | — | — |
| Comparative Example 10 | Comparative Compound No. 10 | 1 | — | — | — |

<Evaluation: Initial Sensitivity and Residual Potential>

The initial sensitivities and residual potentials of the photosensitive member according to Examples 1 to 18 and Comparative Examples 1 to 10 were evaluated under the following conditions.

First, under an environment of a temperature of 23° C./50% RH, the conditions of a charging device were set so that the surface of the electrophotographic photosensitive member is −700 V, using a photosensitive member test apparatus (product name: CYNTHIA 59, manufactured by GENTEC CO., LTD.). The potential of the photosensitive member surface after a monochromatic light having a light quantity of 20 ($\mu J/cm^2$) was irradiated to the surface of the photosensitive member which was charged to −700 V was measured, which was defined as a residual potential (−V). The evaluation results are shown in Table 2.

<Evaluation: Smeared Image Evaluation Under High Temperature and High Humidity Environment>

Smeared image evaluation was carried out under the following conditions, using the photosensitive member according to Examples 1 to 18 and Comparative Examples 1 to 10.

As the electrophotographic apparatus, a modified copying machine of a product name of iR-ADVC 5560, manufactured by Canon Inc., was used. As the charging unit, a rubber roller type contact charging capable of superimposing alternating current on direct current was used. As the modification points, the machine was modified to allow adjustment and measurement of image exposure laser power, an amount of current flowing from the charging roller to the support of the electrophotographic photosensitive member (hereinafter also referred to as total current), and a voltage applied to the charging roller. Further, the copying machine was used while a heater and a cassette heater of the copying machine main body was powered off.

First, the electrophotographic apparatus and the electrophotographic photosensitive member were allowed to stand at a temperature of 30° C. and a humidity of 80% RH as the high temperature and high humidity environment for 24 hours or more, and then the electrophotographic photosensitive members of the Examples and the Comparative Examples were mounted on a cyan cartridge of the electrophotographic apparatus.

Next, as voltage applied to a charging roller, a direct current component was set to −700 V, a frequency of the direct current component was set to 1500 Hz, a potential between peaks Vpp was set to from −400 V to −2000 V at 100 V intervals, and the total current at each applied voltage was measured. Then, a graph with the applied voltage on the horizontal axis and total current on the vertical axis was created, and the applied voltage at which a current amount deviated from the linear approximation curve at an applied voltage from −400 V to −800 V (hereinafter also referred to as a discharge current amount) was 100 μA, was determined. The total current was set to the total current value at the applied voltage at which the discharge current amount was 100 μA.

Next, the charge setting of the copying machine was set so that the dark portion potential was −700 V. A solid image was output in a cyan single color on A4 size plain paper, and the image exposure light quantity was set such that an initial density on paper was measured with a spectrodensity meter (product name: X-rite504, manufactured by X-Rite Inc.) to be 1.45±0.05.

A square grid image having an A4 size, a line width of 0.1 mm, and a line interval of 10 mm was read from a scanner, and 5000 sheets were continuously output in a cyan single color. After image output, the main power of the electrophotographic apparatus was turned off and left for three days. After being left, the main power of the electrophotographic apparatus was turned on, and one sheet of the square grid image was immediately identically output, the smeared image of the output image was visually observed, and the image flow 1 was evaluated based on the following criteria.

Evaluation rank was as follows.

Rank 6: the gird image was clearly output.

Rank 5: no abnormality was found in the gird image.

Rank 4: the horizontal line of the gird image was broken, but no abnormality was found in the vertical line.

Rank 3: the horizontal line of the gird image has disappeared, but no abnormality was found in the vertical line.

Rank 2: the horizontal line of the gird image has disappeared, but the vertical line was not broken.

Rank 1: the horizontal line of the gird image has disappeared, and the vertical line has also disappeared.

At this time, the horizontal line in the grid image refers to a line parallel to a cylindrical axis direction of the photosensitive member, and the vertical line refers to a line perpendicular to the cylindrical axis direction of the photosensitive member. Each of the evaluation results is shown in Table 2.

<Evaluation: Potential Fluctuation Evaluation During Repeated Use Under Low Temperature and Low Humidity Environment>

The photosensitive members according to Examples 1 to 18 and Comparative Examples 1 to 10 were used to evaluate the potential fluctuations during repeated use of the photosensitive member under the low temperature and low humidity environment under the following conditions.

As the electrophotographic apparatus, a modified copying machine of a product name of iR-ADVC 5560, manufactured by Canon Inc., was used. As the modification points, the machine was modified to allow adjustment of potential for charging the photosensitive member from a charging roller and image exposure laser power. The electrophotographic apparatus and the electrophotographic photosensitive member were allowed to stand at a temperature of 15° C. and a humidity of 10% RH as the low temperature and low humidity environment for 48 hours or more, and then the electrophotographic photosensitive member was mounted on a cyan cartridge of the electrophotographic apparatus.

The surface potential of the electrophotographic photosensitive member was measured by taking out a developing cartridge from the evaluation apparatus, inserting a potential measurement device at that position, and performing measurement. The potential measurement device was configured to arrange a potential measurement probe at a developing position of the developing cartridge. The position of the potential measurement probe with respect to the electrophotographic photosensitive member was at the center in the axial direction of the cylindrical electrophotographic photosensitive member, and the gap from the surface of the electrophotographic photosensitive member was 3 mm.

The alternating current component of the charging roller was 1500 Vpp and 1500 Hz, an initial dart portion potential (VDa) was adjusted to −700 V, an initial bright portion potential (VLa) before endurance in image exposure by laser exposure irradiation was adjusted to −200 V, and set values were recorded. The same procedure was performed for each of the electrophotographic photosensitive members for evaluating these operations.

A band image having an image density of 1% was printed, and 1000 sheets were continuously fed. After the end of endurance, a bright portion potential (VLb) after 1000 sheets were fed was measured promptly using the above-described potential measurement device.

Then, a fluctuation amount between the initial bright portion potential (VLa) before feeding papers and the bright portion potential (VLb) after feeding papers was confirmed, which was defined as a bright portion potential fluctuation ΔVL(ab). The results are shown in Table 2.

<Evaluation: Evaluation of Amount of Wear>

The photosensitive members according to Examples 1 to 18 and Comparative Examples 1 to 10 were used to evaluate an amount of wear of the surface layer during repeated use under the following conditions.

As the electrophotographic apparatus, a modified copying machine of a product name of iR-ADVC 5560, manufactured by Canon Inc., was used. As the modification point, the machine was modified to allow adjustment of image exposure laser power.

First, a film thickness of the surface layer at the initial stage of each of the electrophotographic photosensitive members was measured using an interference film thickness meter (product name: MCPD-3700, manufactured by Otsuka Electronics Co., Ltd.).

Next, the electrophotographic apparatus and the electrophotographic photosensitive member were allowed to stand at a temperature of 23° C. and a humidity of 50% RH for 24 hours or more, and then the electrophotographic photosensitive member was mounted on a cyan cartridge of the electrophotographic apparatus. Initially, the conditions of a charging device were set so that the surface of the electrophotographic photosensitive member was −700 V. The image exposure laser power was adjusted thereto and light amount setting to lower the potential from −700 V to −200 V was recorded.

Next, a halftone image was output in a cyan single color on A4 size plain paper, image exposure laser power was set such that a density of the output image was 0.85 with a spectrodensity meter (product name: X-rite504, manufactured by X-Rite Inc.), and 50000 sheets were continuously output.

Next, the electrophotographic photosensitive member was taken out of the electrophotographic apparatus, the film thickness of the surface layer was measured after 50000 sheets output, and the difference in the film thickness of the surface layer before and after 50000 sheets output, that is, the amount of wear was calculated. The above evaluation results are shown in Table 2.

TABLE 2

| | Residual potential (−V) | High temperature and high humidity environment Evaluation of smeared image | Low temperature and low humidity environment Bright portion potential (V) | Amount of wear (μm) |
|---|---|---|---|---|
| Example 1 | 39 | 4 | 5 | 0.4 |
| Example 2 | 41 | 4 | 5 | 0.4 |
| Example 3 | 40 | 5 | 6 | 0.4 |
| Example 4 | 40 | 5 | 6 | 0.5 |
| Example 5 | 45 | 5 | 7 | 0.4 |
| Example 6 | 46 | 4 | 7 | 0.5 |
| Example 7 | 53 | 4 | 7 | 0.6 |
| Example 8 | 57 | 5 | 8 | 0.9 |
| Example 9 | 48 | 5 | 7 | 0.5 |
| Example 10 | 55 | 5 | 8 | 0.8 |
| Example 11 | 60 | 5 | 14 | 0.9 |
| Example 12 | 48 | 5 | 8 | 0.2 |
| Example 13 | 50 | 6 | 10 | 0.3 |
| Example 14 | 56 | 6 | 11 | 0.2 |
| Example 15 | 65 | 6 | 13 | 0.2 |
| Example 16 | 49 | 6 | 8 | 0.3 |
| Example 17 | 49 | 6 | 8 | 0.3 |
| Example 18 | 49 | 6 | 9 | 0.2 |

TABLE 2-continued

| | Residual potential (−V) | High temperature and high humidity environment Evaluation of smeared image | Low temperature and low humidity environment Bright portion potential (V) | Amount of wear (μm) |
|---|---|---|---|---|
| Comparative Example 1 | 71 | 1 | 33 | 0.6 |
| Comparative Example 2 | 43 | 2 | 8 | 0.4 |
| Comparative Example 3 | 89 | 3 | 27 | 1.2 |
| Comparative Example 4 | 67 | 4 | 24 | 0.6 |
| Comparative Example 5 | 68 | 4 | 21 | 0.5 |
| Comparative Example 6 | 70 | 3 | 35 | 0.8 |
| Comparative Example 7 | 85 | Not measurable | Not measurable | Not measurable |
| Comparative Example 8 | 73 | 3 | 17 | 1.4 |
| Comparative Example 9 | 77 | 1 | 29 | 0.7 |
| Comparative Example 10 | 70 | 1 | 32 | 0.9 |

In the Examples using the hole transporting compound according to the present invention, the smeared image, the potential fluctuation under the low temperature and low humidity environment, and the wear resistance were able to be improved in a well-balanced manner.

In Examples 12 to 18 using the compound represented by Formula (2), the smeared image under the high temperature and high humidity environment was more effectively suppressed, and the wear resistance was excellent. In addition, the evaluation results of the potential fluctuation under the low temperature and low humidity environment were also excellent.

In Comparative Example 7 using Comparative Compound No. 7, the polymerization reaction did not proceed well, and the repeated use test was impossible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-118897, filed Jun. 22, 2018, which is hereby incorporated by reference wherein in its entirety.

What is claimed is:

1. An electrophotographic photosensitive member, comprising:

a support;

a photosensitive layer above the support; and a surface layer that includes a copolymerization product of a composition containing a hole transporting compound represented by Formula (1) and a compound represented by Formula (2):

(1)

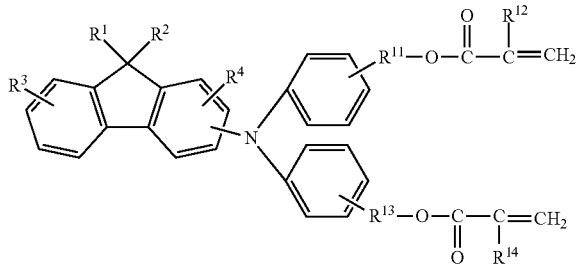

where $R^1$ and $R^2$ independently represent an alkyl group having 2 to 8 carbon atoms, $R^3$ and $R^4$ independently represent a hydrogen atom or an alkyl group having 4 or less carbon atoms, $R^{11}$ and $R^{13}$ independently represent an alkylene group having 3 to 6 carbon atoms, and $R^{12}$ and $R^{14}$ independently represent a hydrogen atom or a methyl group, and (2)

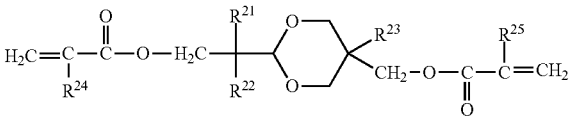

where $R^{21}$ and $R^{22}$ independently represent an alkyl group having 1 to 4 carbon atoms, or a substituted or unsubstituted benzyl group, the substituent of the benzyl group is an alkyl group having 4 or less carbon atoms, $R^{21}$ and $R^{22}$ may be bonded to each other to form a ring, $R^{23}$ represents an alkyl group having 1 to 4 carbon atoms, and $R^{24}$ and $R^{25}$ independently represent a hydrogen atom or a methyl group.

2. The electrophotographic photosensitive member according to claim 1, where $R^1$ and $R^2$ are independently an alkyl group having 2 to 5 carbon atoms, and $R^{11}$ and $R^{13}$ are each a propylene group.

3. The electrophotographic photosensitive member according to claim 2, where $R^1$ and $R^2$ are each a propyl group.

4. The electrophotographic photosensitive member according to claim 1, where at least one of $R^{21}$ and $R^{22}$ is an alkyl group having 2 or more carbon atoms.

5. An electrophotographic apparatus comprising: an electrophotographic photosensitive member, a charging unit, an exposing unit, a developing unit and a transfer unit, wherein the electrophotographic photosensitive member includes a support, a photosensitive layer above the support, and a surface layer that includes a copolymerization product of a composition containing a hole transporting compound represented by Formula (1) and a compound represented by Formula (2):

(1)

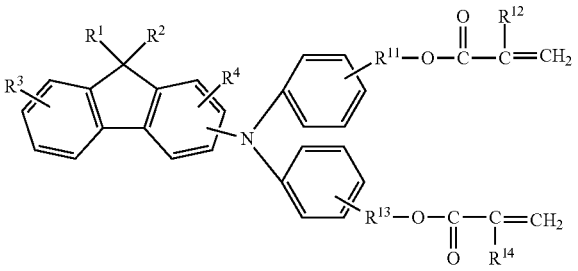

where $R^1$ and $R^2$ independently represent an alkyl group having 2 to 8 carbon atoms, $R^3$ and $R^4$ independently represent a hydrogen atom or an alkyl group having 4 or less carbon atoms, $R^{11}$ and $R^{13}$ independently represent an alkylene group having 3 to 6 carbon atoms, and $R^{12}$ and $R^{14}$ independently represent a hydrogen atom or a methyl group, and (2)

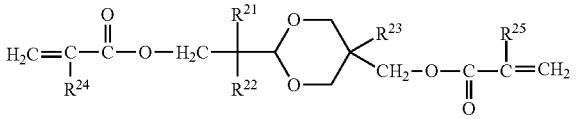

where $R^{21}$ and $R^{22}$ independently represent an alkyl group having 1 to 4 carbon atoms, or a substituted or unsubstituted benzyl group, the substituent of the benzyl group is an alkyl group having 4 or less carbon atoms, $R^{21}$ and $R^{22}$ may be bonded to each other to form a ring, $R^{23}$ represents an alkyl group having 1 to 4 carbon atoms, and $R^{24}$ and $R^{25}$ independently represent a hydrogen atom or a methyl group.

6. The electrophotographic apparatus according to claim 5, where at least one of $R^{21}$ and $R^{22}$ is an alkyl group having 2 or more carbon atoms.

7. A process cartridge which integrally supports an electrophotographic photosensitive member and at least one unit selected from the group consisting of a charging unit, a developing unit, a transfer unit and a cleaning unit, and is detachably attachable to an electrophotographic apparatus main body, wherein the electrophotographic photosensitive member includes a support, a photosensitive layer above the support, and a surface layer that includes a copolymerization product of a composition containing a hole transporting compound represented by Formula (1) and a compound represented by Formula (2):

(1)

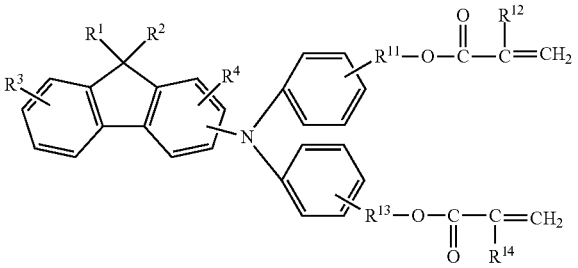

where $R^1$ and $R^2$ independently represent an alkyl group having 2 to 8 carbon atoms, $R^3$ and $R^4$ independently represent a hydrogen atom or an alkyl group having 4 or less carbon atoms, $R^{11}$ and $R^{13}$ independently represent an alkylene group having 3 to 6 carbon atoms, and $R^{12}$ and $R^{14}$ independently represent a hydrogen atom or a methyl group, and (2)

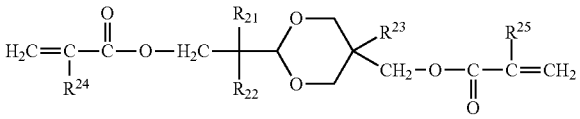

where $R^{21}$ and $R^{22}$ independently represent an alkyl group having 1 to 4 carbon atoms, or a substituted or unsubstituted benzyl group, the substituent of the benzyl group is an alkyl group having 4 or less carbon atoms, $R^{21}$ and $R^{22}$ may be bonded to each other to form a ring, $R^{23}$ represents an alkyl group having 1 to 4 carbon atoms, and $R^{24}$ and $R^{25}$ independently represent a hydrogen atom or a methyl group.

8. The process cartridge according to claim 7, where at least one of $R^{21}$ and $R^{22}$ is an alkyl group having 2 or more carbon atoms.

9. A method of producing an electrophotographic photosensitive member including a support and a photosensitive layer above the support, the method comprising:

(i) forming a coating film of a coating solution composition for a surface layer of the electrophotographic photosensitive member, said composition containing a hole transporting compound represented by Formula (1) and a compound represented by Formula (2):

(1)

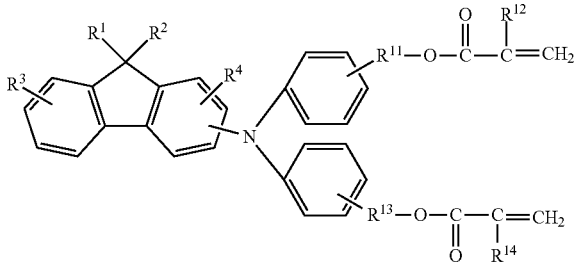

where $R^1$ and $R^2$ independently represent an alkyl group having 2 to 8 carbon atoms, $R^3$ and $R^4$ independently represent a hydrogen atom or an alkyl group having 4 or less carbon atoms, $R^{11}$ and $R^{13}$ independently represent an alkylene group having 3 to 6 carbon atoms, and $R^{12}$ and $R^{14}$ independently represent a hydrogen atom or a methyl group, and (2)

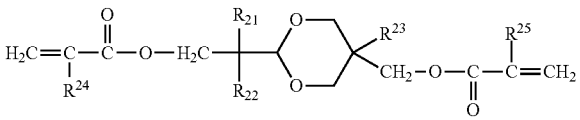

where $R^{21}$ and $R^{22}$ independently represent an alkyl group having 1 to 4 carbon atoms, or a substituted or unsubstituted benzyl group, the substituent of the benzyl group is an alkyl group having 4 or less carbon atoms, $R^{21}$ and $R^{22}$ may be bonded to each other to form a ring, $R^{23}$ represents an alkyl group having 1 to 4 carbon atoms, and $R^{24}$ and $R^{25}$ independently represent a hydrogen atom or a methyl group; and (ii) forming the surface layer by a copolymerization reaction of the coating solution composition in the coating film.

10. The method of producing an electrophotographic photosensitive member according to claim 9, wherein a content of the hole transporting compound represented by Formula (1) in the coating solution composition for a surface layer is 50% by mass or more with respect to a total mass of the hole transporting compound represented by Formula (1) and the compound represented by Formula (2) in the coating solution composition for a surface layer.

11. The method of producing an electrophotographic photosensitive member according to claim 9, where at least one of $R^{21}$ and $R^{22}$ is an alkyl group having 2 or more carbon atoms.

* * * * *